US005557290A

United States Patent [19]

Watanabe

[11] Patent Number: 5,557,290

[45] Date of Patent: Sep. 17, 1996

[54] COUPLING APPARATUS BETWEEN COAXIAL CABLES AND ANTENNA SYSTEM USING THE COUPLING APPARATUS

[75] Inventor: Hironobu Watanabe, Yono, Japan

[73] Assignee: Daiichi Denpa Kogyo Kabushiki Kaisha, Tokyo-To, Japan

[21] Appl. No.: 557,676

[22] Filed: Nov. 13, 1995

Related U.S. Application Data

[63] Continuation of Ser. No. 160,277, Dec. 2, 1993, abandoned.

[30] Foreign Application Priority Data

Dec. 16, 1992 [JP] Japan ..... 4-335802

[51] Int. Cl.[6] ..... H01Q 1/32

[52] U.S. Cl. ..... 343/713; 343/715; 343/860

[58] Field of Search ..... 343/713, 860, 343/715, 850, 861, 862; 333/24 C, 32; H01Q 1/32

[56] References Cited

U.S. PATENT DOCUMENTS

| | | | |
|---|---|---|---|
| 4,621,243 | 11/1986 | Harada | 343/715 X |
| 4,706,048 | 11/1987 | Atalar | 333/32 |
| 4,764,773 | 8/1988 | Larsen et al. | 343/713 |
| 5,105,201 | 4/1992 | Nakase et al. | 343/713 X |
| 5,216,434 | 6/1993 | Fukumura | 343/894 X |
| 5,471,222 | 11/1995 | Du | 343/715 X |

FOREIGN PATENT DOCUMENTS

| | | |
|---|---|---|
| 3-34704 | 2/1991 | Japan . |

*Primary Examiner*—Donald T. Hajec
*Assistant Examiner*—Tho Phan
*Attorney, Agent, or Firm*—Fish & Richardson, P.C.

[57] ABSTRACT

Coaxial cables can connect both apparatus which are provided inside and outside a closed space without opening a through hole and a gap into a wall and door. In a coupling apparatus for connecting coaxial cables each other through a dielectric plate, there are provided a pair of central electrodes which are respectively connected central conductors of the coaxial cables, an inductor which is connected between at least one of the central conductor and the central electrode, and a pair of outer electrodes which oppose each other through the dielectric plate and surround the central electrodes, respectively, and each of which is connected to each of the outer electrodes. It is possible to connect the coaxial cables through the dielectric (glass) plate.

16 Claims, 33 Drawing Sheets

COUPLING APPARATUS BETWEEN COAXIAL CABLES AND ANTENNA SYSTEM USING THE COUPLING APPARATUS

This application is a continuation of U.S. application Ser. No. 08/160,277, filed Dec. 2, 1993, now abandoned.

BACKGROUND OF THE INVENTION

The present invention relates to a coupling apparatus for connecting coaxial cables, which are lines for transmitting a high-frequency energy, and more particularly, to a coupling apparatus for coaxial cables capable of connecting radio equipment components to each other, the equipment components being provided inside and/or outside a closed space such as an interior of a room, vehicle and the like. The present invention further relates to an antenna system using the coupling apparatus between coaxial cables described above.

A mobile radio communication system, which is loaded on an automobile or vehicle, is configured from a radio apparatus main body loaded on an interior of the vehicle, an antenna provided on an outer surface of the vehicle for transmitting and receiving radio wave, and a coaxial cable for connecting the radio apparatus main body and the antenna. The coaxial cable extends from the interior of the vehicle to the outside of the vehicle to be connected with the antenna. Two known methods of connection include opening a hole for passing through the coaxial cable, other is to cause the coaxial cable to pass through a gap between a body and a door of the vehicle by using a partially narrow coaxial cable. In the same manner, when an outdoor reception antenna is connected to a radio apparatus such as a television receiving set which is positioned in the interior of a house, a coaxial cable is wired through a hole opened in a part of the house or a gap such as a window for connecting the antenna and the radio apparatus.

Opening a hole through the vehicle body is a troublesome matter and the hole causes the property value of the vehicle to be reduced. Using the gap between the body and door has the possibility for cutting the coaxial cable. Furthermore, it is the problem that there are draft noises and rain leaks through the hole and gap.

Likewise, it is troublesome to open the through-hole in ferro-concrete buildings in the later. Furthermore, a tenant is not generally permitted to open the hole through the wall in the case of a rented house or an apartment complex.

Accordingly, there is provided a method of connected coaxial cables without opening a hole through the vehicle body or wall, in which an antenna is mounted on the window glass, capacitance coupling portions are formed by electrodes attached on both side of the window glass, and high-frequency signals are supplied from the antenna through the outside coaxial cable, the capacitance coupling portions and the inside coaxial cable. FIG. 1A shows an example of an antenna apparatus of KG144 type produced by Lasen Electronics Inc. in USA. The antenna apparatus comprises a capacitor 2 connected to a central conductor of a coaxial cable 4 and a capacitor 3 connected to an outer conductor of the coaxial cable 4. The capacitor 2 is configured from a pair of rectangular electrodes 2*a* which are provided at both sides of a glass plate 1 in the manner of opposing each other. The capacitor 3 is configured from a pair of rectangular electrodes 3*a* which are provided at both sides of the glass plate 1 in the manner of opposing each other. The capacitor 2 is connected through a capacitor C to an end of an outer antenna 300. The capacitor 3 is connected through an inductor L to the outer antenna 300.

FIG. 1B shows an example of an antenna apparatus of an AP143 type produced by Avanti in USA. The antenna apparatus uses a capacitor 2 including electrodes 2*a* which oppose each other through a glass plate 1. One electrode 2*a* of the capacitor 2 is connected to an antenna 300, and the other electrode 2*a* is connected to an inner conductor of a coaxial cable 4. An outer conductor of the coaxial cable 4 is connected to the inner conductor of the coaxial cable 4 through an impedance circuit including an inductor L and capacitor C.

Furthermore, there is a glass passing type antenna (not shown) for an automobile radio receiver, as another example of such a glass passing type antenna, which is disclosed in the official gazette of Japanese Patent Laid-open No. 3-34704 (1991). The antenna uses an LC multipletuned circuit of an electromagnetic coupling which are formed at both sides of a glass plate for frequency modulated (FM) signals, while the antenna uses a capacitor and FET amplifier formed at both sides of the glass plate for amplitude modulated (AM) signals, thereby transmitting a high-frequency signal inside and outside of the cabin.

However, even though such kinds of conventional antenna apparatus have coaxial cables which are wired near the inner surface of the glass plate, it is impossible to transmit a high-frequency energy while maintaining a coaxial transmission mode to the outer antenna apparatus outside the glass plate.

As a result, an impedance matching is not balanced well between the coaxial cable 4 and antenna 300. An antenna current flows into the outer conductor of the coaxial cable 4, so that it is easy to generate a so-called radio wave leakage from the coaxial cable. A transmission efficiency of the high-frequency power decreases. Particularly, the conventional apparatus have the problem that it is difficult to actually use the apparatus in a land mobile radiotelephone, a combined use radio telephone apparatus as a mobile and portable set, and a compact transceiver which are required the high transmission efficiency because they only have a low transmission power.

Since the glass passing type antenna apparatus of such a kind is limited an attached position of the antenna onto the glass surface, an antenna of the desired kind is required to be set to the proper position such as a roof of the vehicle by extending the coaxial cable along the body surface. In same manner, in the buildings, it is required to set an antenna of the most fitted kind to the proper position such as a balcony or roof without a window glass. Furthermore, it is desired to connect a plurality of antennas for performing a diversity receiving system and corresponding to a plurality of broadcasting stations in the different directions, to the coaxial cables in the transmission reception apparatus through the glass plate.

SUMMARY OF THE INVENTION

In order to solve the above problems, an object of the present invention is to provide a coupling apparatus for coaxial cables, capable of substantially connecting each other between high frequency apparatuses which are provided inside and outside a closed space without opening a through hole or a gap into a wall, door or glass plate.

Another object of the present invention is to provide an antenna system set onto a dielectric plate such as a glass plate capable of transmitting and receiving an electric power by a coaxial transmission mode between the antenna side and the coaxial cable side through the dielectric plate.

In order to achieve the above object, a coupling apparatus for coaxial cables according to the present invention for connecting coaxial cables to each other through a dielectric plate, comprises a pair of central electrodes which are provided in the manner of opposing each other through the dielectric plate, and respectively connected to central conductors of coaxial cables on both sides of the dielectric plate, a pair of outer electrodes which oppose each other through the dielectric plate and are respectively connected to outer conductors of the coaxial cables, and a matching circuit which is connected between the central electrodes and the central conductors.

To achieve another object, an antenna apparatus according to the present invention for supplying a high frequency power from a coaxial cable through a dielectric plate to an antenna portion mounted onto the dielectric plate, comprises a pair of central electrodes which are provided in the manner of opposing each other on both sides of the dielectric plate and in which one side is connected to a central conductor of the coaxial cable and the other is connected to the antenna portion, a pair of outer electrodes which are positioned around the central electrodes and in which one side is connected to an outer conductor of the coaxial cable, a first matching circuit provided between the central conductor of the cable and one side central electrode, and a second matching circuit provided between the antenna portion and the central electrode on the other side.

A pair of the central electrodes are positioned in the manner of opposing each other onto both surfaces of the dielectric plate such as a glass plate. A pair of the outer electrodes are further positioned around the central electrodes onto both surfaces of the dielectric plate in the manner that the outer electrodes oppose each other. The dielectric plate, the central electrodes and the outer electrodes constitute a capacitive coupling portion. In the capacitive coupling portion, the central electrode is connected through the matching circuit to the central conductor of the coaxial cable, and the outer electrode is connected to the outer conductor of the coaxial cable. The matching circuit constitutes a series resonance circuit or a parallel resonance circuit with a capacitor formed by the opposed central electrodes, thereby enabling high frequency signals to pass through the dielectric plate at a resonance frequency with low loss. By the above constitution, the central electrodes and the outer electrodes at both sides of the dielectric plate are respectively coupled with each other at a high frequency. Since the outer electrodes enclose the central electrodes, respectively, radio waves are not radiated from the central electrodes and the central electrodes do not couple with other portions, thereby extremely maintaining a coaxial transmission mode. When one coaxial cable is connected with the central and outer electrodes on one side of the capacitive coupling portion and the other cable is connected with the other central and outer electrodes on the other side of the capacitive coupling portion, since a coaxial transmission mode is kept between two coaxial cables, the high frequency power can be transmitted.

Furthermore, when the antenna is connected to the central electrode on one side of the capacitive coupling portion, it is possible to obtain a supply of the high frequency power by a coaxial transmission mode through the coaxial cable connected to the electrode on the other side.

As described above, since the coupling apparatus for coaxial cables according to the present invention has the constitution that a pair of the coupling central electrodes are positioned on the dielectric plate in the manner of opposing each other, a pair of the outer electrodes is arranged respectively around the central electrodes on the dielectric plate, the central conductors of both the coaxial cables are connected to the central electrodes through matching inductor, respectively, and the outer conductors of both the coaxial cables are connected to the outer electrodes, respectively, even though the dielectric plate physically shuts down the coaxial cables, both of the coaxial cables inside and outside the closed space are connected with each other by the coaxial transmission mode. Furthermore, since the high frequency power is transmitted in an unbalanced mode between both of the coaxial cables, the coaxial cable keeps the advantages of no externally induction interference and no leakage of the radio wave to outside, and at the same time, it is possible to realize a cable connection having an extremely low loss in a frequency band of set signals. Still furthermore, when a plurality of coupling central electrodes are provided, it is possible to simply design a plurality of signal passed frequency band thereby enabling a wide band of signals and easy distributing the high frequency signals.

It is possible to constitute an antenna system when an antenna combines with the coaxial cable coupling apparatus in one body. In this case, power is transmitted by a low loss through the dielectric plate to the antenna outside a vehicle (room) space. Also, since the outer conductor as a grounding system is introduced to the outside of the vehicle (room) space side to connect with a grounding system and earth line of the antenna, it is possible to easily connect with an unbalanced type antenna. Of course, it is possible also to connect with a balanced antenna through a balun (balanced-to-unbalanced transformer).

DETAILED DESCRIPTION OF THE PREFERRED EMBODIMENTS

Figure 2:
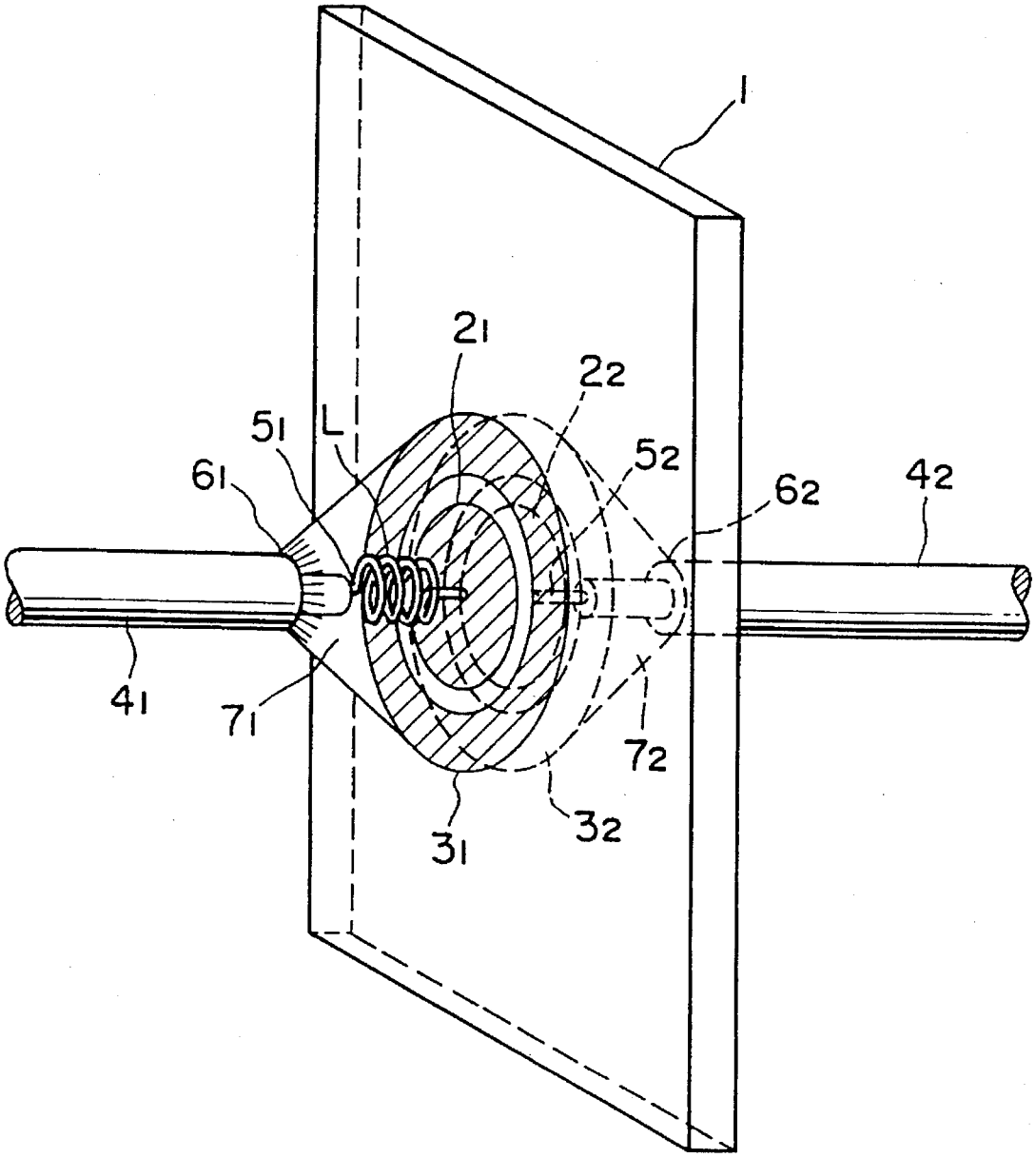
FIG. 2 is an explanatory view showing a principle constitution of a coupling apparatus according to the present.

There will be described in detail preferred embodiments according to the present invention in reference with the attached drawings. FIG. 2 is a perspective view for explaining a basic constitution of the present invention.

In FIG. 2, a glass plate 1 as a dielectric is a part of a wall for enclosing a closed space (not shown), and corresponds to a window glass of vehicles or buildings. The glass plate 1 divides a space into two portions, for example, one portion corresponds to an interior of the room or a cabin of the vehicle, and the other portion corresponds to an exterior of the room or the vehicle. A central electrode $\mathbf{2}_1$ having a disc shape is arranged onto a main surface of the glass plate 1. An outer electrode $\mathbf{3}_1$ having a ring shape is arranged around the central electrode $\mathbf{2}_1$. The central electrode $\mathbf{2}_1$ is connected to a central conductor $\mathbf{5}_1$ of a coaxial cable $\mathbf{4}_1$ through an inductor L. The outer electrode $\mathbf{3}_1$ is connected to an outer conductor $\mathbf{6}_1$ through a metallic shield member $\mathbf{7}_1$ which covers entire the central electrode $\mathbf{2}_1$, inductor L and outer electrode $\mathbf{3}_1$ for maintaining a signal transmission of a coaxial mode to a glass surface and for preventing a radio wave leakage outward and an induction interference from an exterior.

Onto the other main surface of the glass plate 1, a central electrode $\mathbf{2}_2$ is arranged to oppose the central electrode $\mathbf{2}_1$. An outer electrode $\mathbf{3}_2$ having a ring shape is arranged opposing to the outer electrode $\mathbf{3}_1$. The central electrode $\mathbf{2}_2$ is connected to a central conductor $\mathbf{5}_2$ of a coaxial cable $\mathbf{4}_2$. The outer electrode $\mathbf{3}_2$ is connected to an outer conductor $\mathbf{6}_2$ of the coaxial cable $\mathbf{4}_2$ through a metallic shield member $\mathbf{7}_2$ which covers entire the central electrode $\mathbf{2}_1$, inductor L and outer electrode $\mathbf{3}_1$ for maintaining a signal transmission of a coaxial mode to a glass surface and for preventing a radio wave leakage outward and an induction interference from an exterior. The other end of the coaxial cable $\mathbf{4}_1$ is connected to, for example, an antenna system (not shown), and the other end of the coaxial cable $\mathbf{4}_2$ is connected to a transceiver (a transmitter and receiver) which is not shown in the figure.

By the above constitution, the central electrodes $\mathbf{2}_1$ and $\mathbf{2}_2$ form a disc shape capacitor opposing to each other through the glass plate 1, and cause the inner conductors $\mathbf{4}_1$ and $\mathbf{4}_2$ of the coaxial cables to be electrically interconnected by a capacitive coupling. The central electrodes $3_1$ and $3_2$ form a ring shape capacitor opposing to each other through the glass plate 1, and cause the inner conductors $6_1$ and $6_2$ of the coaxial cables to also be electrically interconnected by a capacitive coupling. The inductor L is inserted into the capacitor in series and counterbalances the capacitance occurring by the capacitive coupling so as to match an impedance. Accordingly, in a coupled portion between the coaxial cables $4_1$ and $4_2$, the outer coupling electrodes are arranged around respective central coupling electrodes, so that both of the central conductors are interconnected with each other and both of the outer electrodes are interconnected with each other. Since the coupling portion performed an impedance matching maintains a coaxial transmission mode, the central electrode neither irradiates a radio wave nor couples the other portions, thereby extremely transmitting a radio wave in an unbalanced condition which is a high-frequency potential mode in which the central electrode changes potentials between positive and negative ones with reference to a potential of the outer conductor as a reference potential.

Furthermore, when an impedance matching circuit is provided in the closed space surrounded by the shield member $7_1$ and $7_2$ mentioned in detail later, it is possible to improve a transmission characteristic in coupling. As will be later described in detail, the present invention causes the coupling apparatus to be constituted from a variable matching circuit and to have a measuring meter for directing a matching condition in the closed space in order to be adjustable to obtain optimum coupling, respectively, thereby easily adapting various thickness and materials of the dielectric with the coupling apparatus according to the present invention. Thus when heating wires for preventing the glass plate from fogging and wires for reinforcing the glass plate are laid inside in the glass plate, the electrodes are formed in the proper shape to avoid the heating wire and reinforced wire. Since the central and outer electrodes are attached to a surface of the glass plate, they have ordinarily a plane shape, respectively. However, when the glass plate has a curved surface or a rugged surface, the central and outer electrodes have a uneven surface corresponding to the glass plate surface.

Even though both ends of the above-mentioned coupling apparatus are connected to coaxial cables, respectively, one end of the coupling apparatus may be connected to an antenna system directly or through a proper matching circuit. In this case, for example, the central electrode of the coupling apparatus is connected to an unbalanced type vertical antenna (for a coaxial cable) and the outer electrode is connected to an earthen neutral system of the vertical antenna. Furthermore, when the coupling apparatus is connected to a balanced antenna, since an unbalanced output can be directly obtained outside the glass plate, an unbalanced-to-balanced transformer (balun) should be provided between the coupling apparatus and the antenna.

Figure 3A:
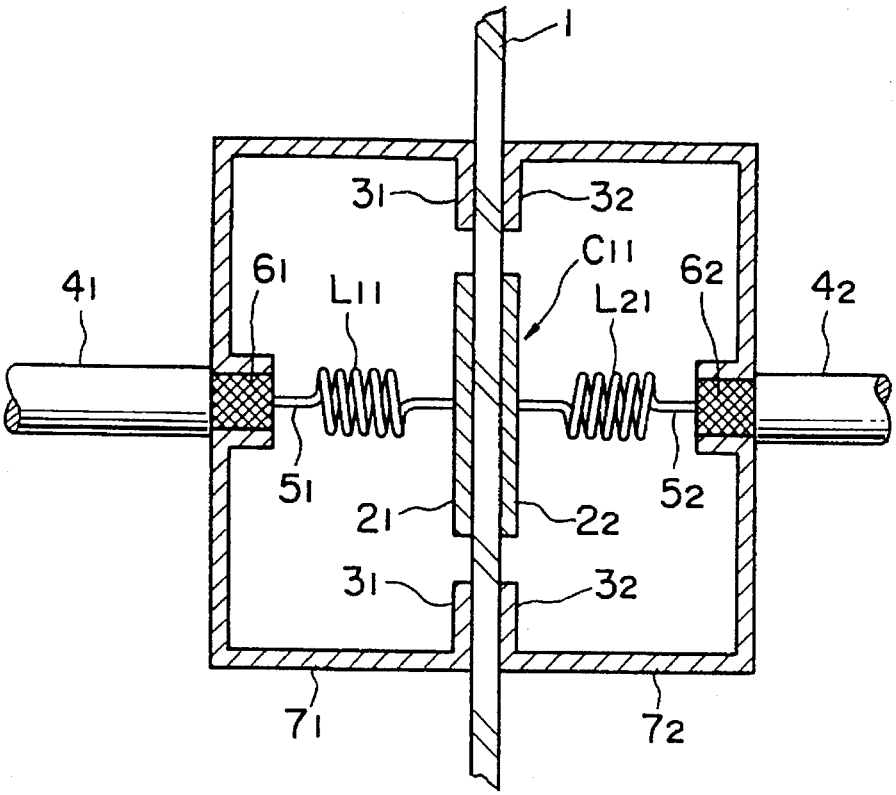
FIG. 3A is a sectional view showing an example of a coupling apparatus for coaxial cables according to the present invention.

FIG. 3A is a sectional view showing an example of the coaxial cable coupling apparatus according to the present invention. In this figure, portions corresponding to those shown in FIG. 2 are denoted by the same numerals as those in FIG. 2. This example has an inductor $L_{11}$ connected between the central electrode $2_1$ and the central conductor $5_1$ of the coaxial cable $4_1$ on one side, while an inductor $L_{21}$ is connected between the central electrode $2_2$ and the central conductor $5_2$ of the coaxial cable $4_2$ on the other side. The inductors $L_{11}$ and $L_{21}$ form a series resonance circuit with a capacitor $C_{11}$ which is formed by the central electrode $2_1$ and $2_2$, so as to negate the capacitor $C_{11}$. An outer conductor $6_1$ of the coaxial cable $4_1$ is connected to the metallic shield case $7_1$ which is, for example, a cylindrical case in which a plane contacting to the glass plate opens and an outer electrode $3_1$ having a ring shape is formed at an opening portion in the manner of contacting to the glass plate surface. Furthermore, a matching circuit may be provided in the shield case under the consideration of a matching with a coaxial transmission path and a load circuit. The same constitution is provided on the side of the coaxial cable $4_2$. One inductor can also perform an impedance matching the coupling capacitor $C_{11}$ as shown in FIG. 2.

Figure 3B:
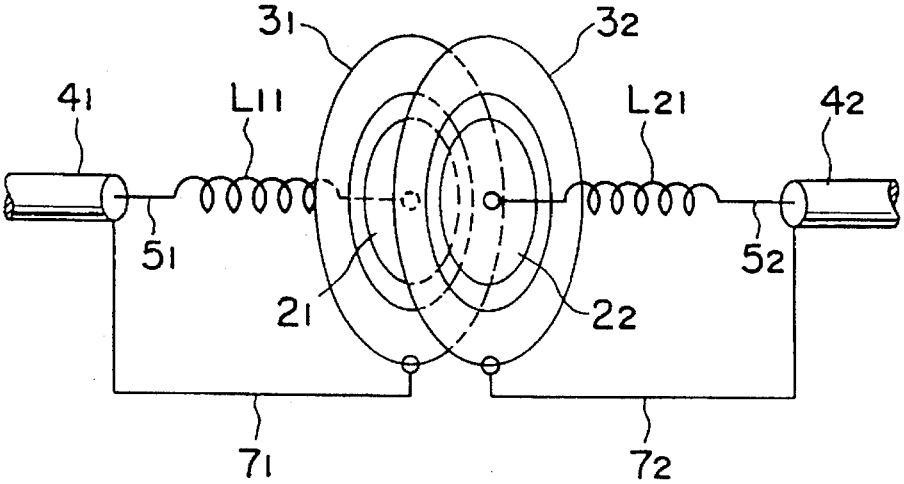
FIG. 3B is an explanatory view showing an electric equivalent circuit of the coupling apparatus shown in FIG. 3A.
Figure 10A:
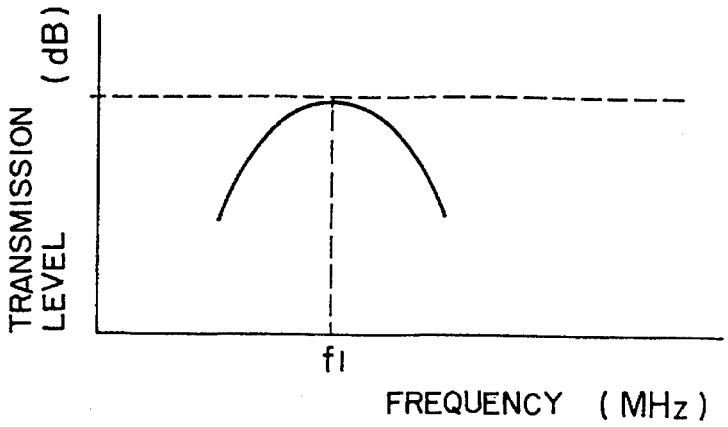
FIGS. 10A–10C are graphs respectively showing transmission characteristics corresponding to frequency in the coaxial cable coupling apparatus shown in FIGS. 7–9.

FIG. 3B shows an equivalent circuit of the coaxial cable coupling apparatus shown in FIG. 3A. Portions shown in FIG. 3B corresponding to portions in FIG. 3A are denoted by the same numerals. The coaxial cables as an unbalanced circuit are coupled by two pairs of electrodes $2_1$, $2_2$ and $3_1$, $3_2$ which are arranged in a coaxial condition and opposing to each other through the glass plate. FIG. 10A shows an example of a transmission characteristic corresponding to a frequency in the coaxial cable coupling apparatus. A bandpass characteristic is observed in the manner of extremely reducing a signal attenuation near a resonance frequency $f_1$ of the series resonance circuit including the inductor $L_{11}$ and $L_{21}$ and the coupling capacitor $C_{11}$.

Figure 4:
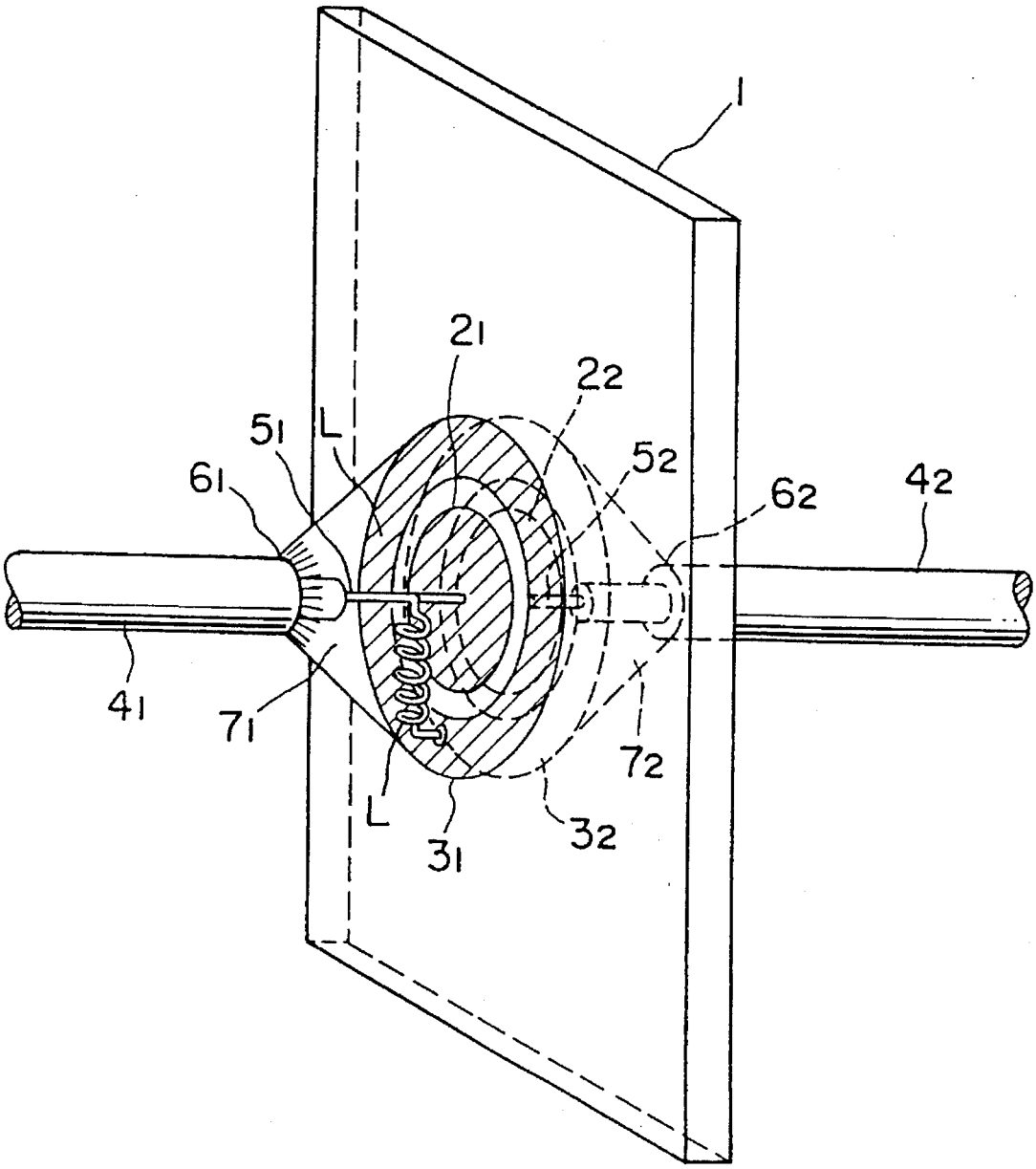
FIG. 4 is an explanatory view showing an example of another impedance matching in the coupling apparatus according to the present invention.

FIG. 4 shows another example of an impedance matching. Portions in FIG. 4 corresponding to those in FIG. 2 are attached by the same numeral and the duplicated description is omitted. A coaxial cable coupling apparatus shown in FIG. 4 includes an inductor L connected between the central electrode $2_1$ and outer electrode $3_1$ constituting the capacitive coupling. It is possible to perform an impedance matching by the constitution in which the inductor L is connected in parallel with the coupling capacitor.

Figure 5A:
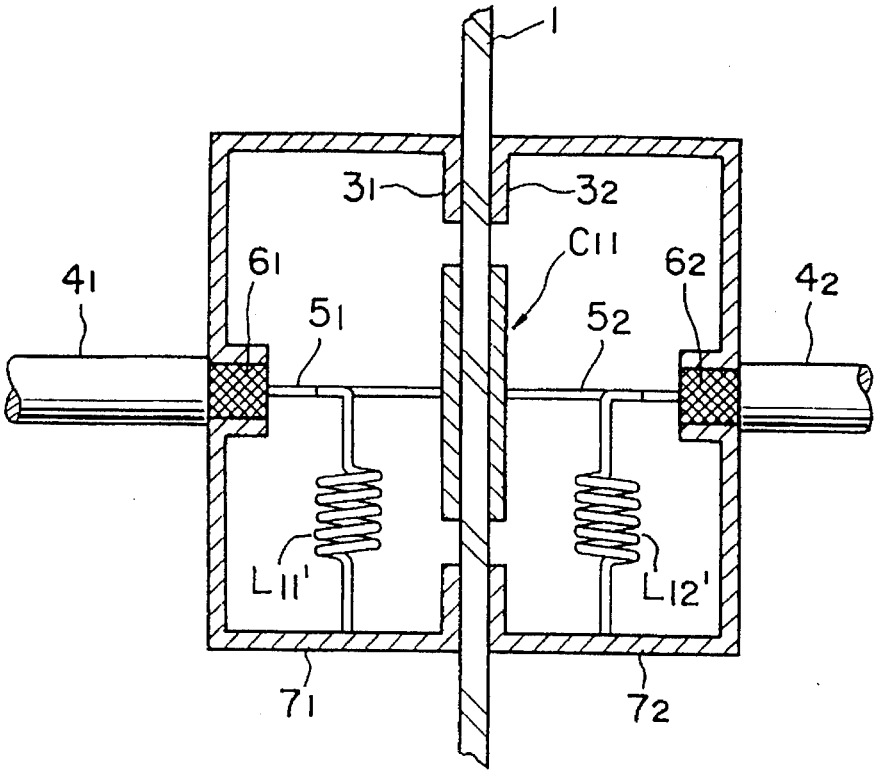
FIG. 5A is a sectional view showing an example of the coaxial cable coupling apparatus shown in FIG. 4.

FIG. 5A is a sectional view showing a constitution example of the coaxial cable coupling apparatus shown in FIG. 4. Portions in FIG. 5A corresponding to those in FIG. 3A are denoted as the same numerals in FIG. 3A. In this example, inductor $L_{11}'$ and $L_{21}'$ are connected between the central and outer electrodes (accordingly, between the central conductor $5_1$ and the external conductor $6_1$) in the manner of putting a coupling capacitance $C_{11}$ therebetween. Two inductors $L_{11}'$ and $L_{21}'$ constitute a resonance circuit with the coupling capacitance $C_{11}$ which is formed by the central electrodes $2_1$ and $2_2$, so as to negate the capacitance $C_{11}$. The outer conductor $6_1$ of the coaxial cable $4_1$ is connected to the metallic shield case $7_1$ which is, for example, a cylindrical case in which a plane contacting to the glass plate opens and an outer electrode 31 having a ring shape is formed at an opening portion in the manner of contacting to the glass plate surface. Furthermore, a matching circuit may be provided in the shield case under the consideration of a matching with a coaxial transmission path and a load circuit. The same constitution is provided on the side of the coaxial cable $4_2$.

Figure 5B:
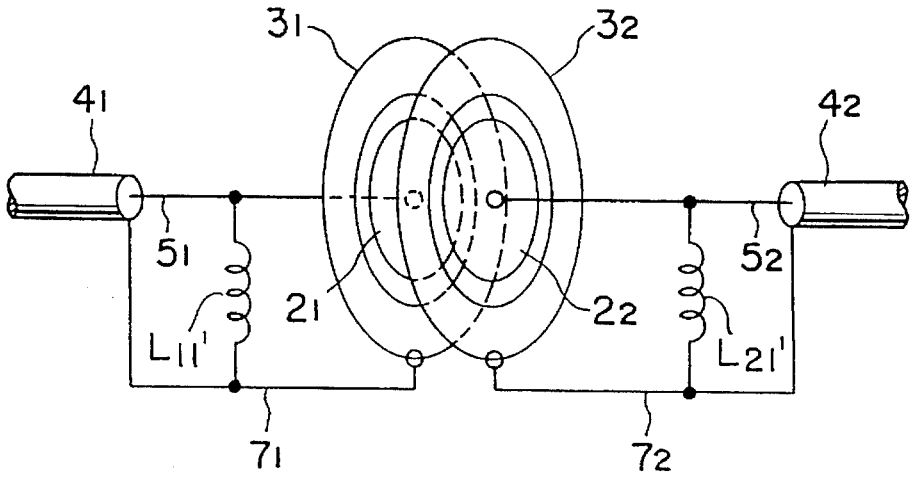
FIG. 5B is an explanatory view showing an electric equivalent circuit of the apparatus shown in FIG. 5A.

FIG. 5B shows an equivalent circuit of the coaxial cable coupling apparatus shown in FIG. 5A. Portions shown in FIG. 5B corresponding to portions in FIG. 5A are denoted by the same numerals. The coaxial cables as an unbalanced circuit are coupled by two pairs of electrodes $2_1$, $2_2$ and $3_1$, $3_2$ which are arranged in a coaxial condition and opposing to each other through the glass plate. The coupling capacitor $C_{11}$ is eliminated by the inductor $L_{11}'$ and $L_{21}'$.

Figure 6:
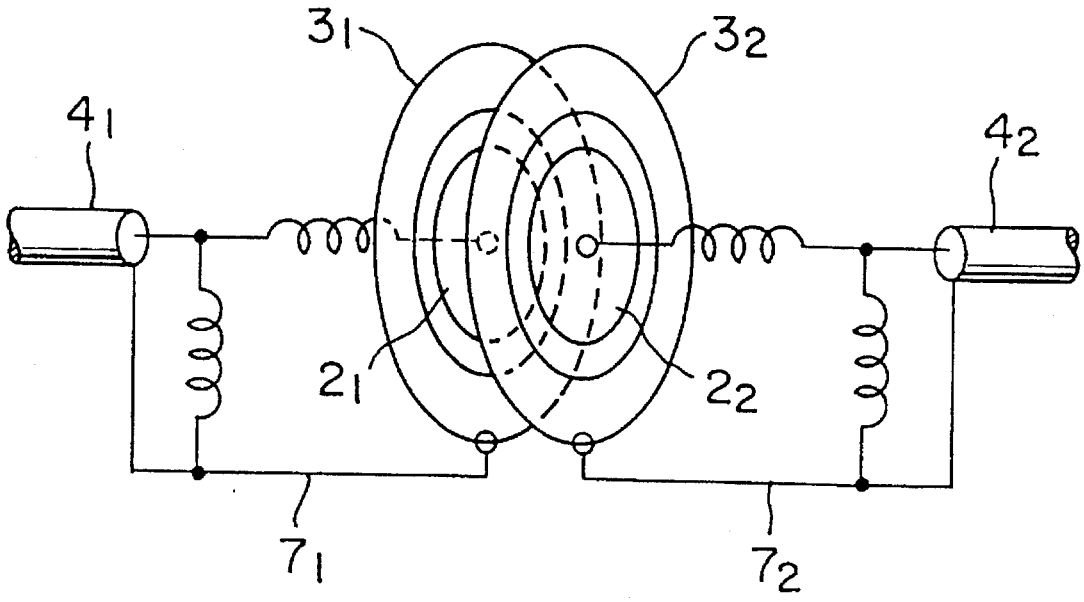
FIG. 6 is an explanatory view showing a combined example of inductance matching circuits shown in FIGS. 3B and 5B.

As shown in FIG. 6, it is possible to insert an inductance in an L-shape between the central electrode and the central conductor of the coaxial cable in order to perform a matching. The matching circuit combining the circuits shown in FIGS. 3A and 5A, is described later in a multipletuned type matching circuit shown in FIG. 31.

Figure 7A:
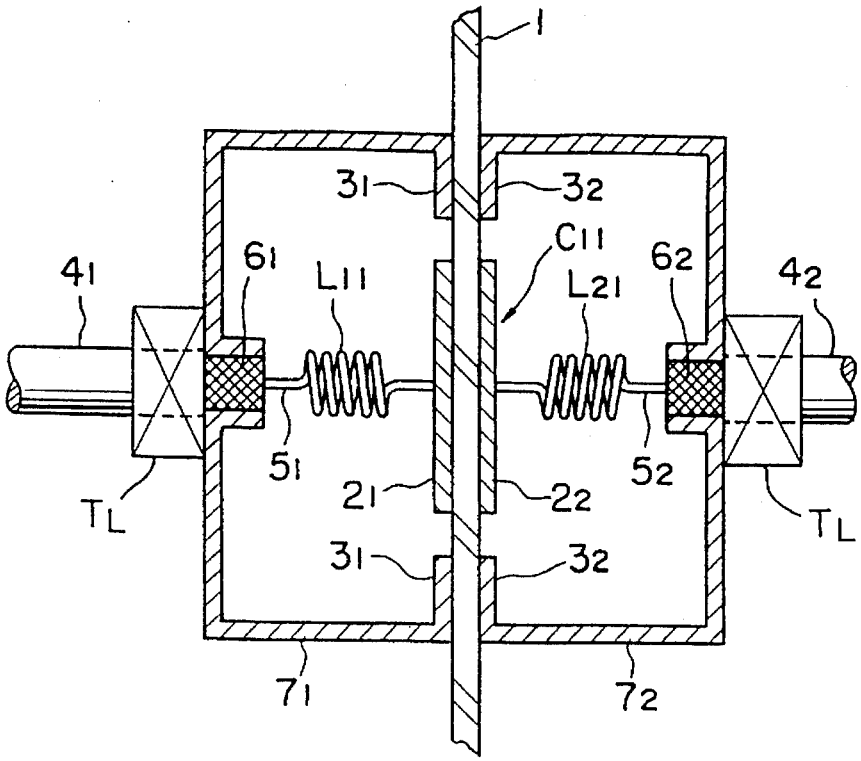
FIG. 7A is a sectional view showing an example in which a toroidal core $T_L$ is loaded to the coaxial cable for suppressing a current flowing into an outer conductor of the coaxial cable.
Figure 7B:
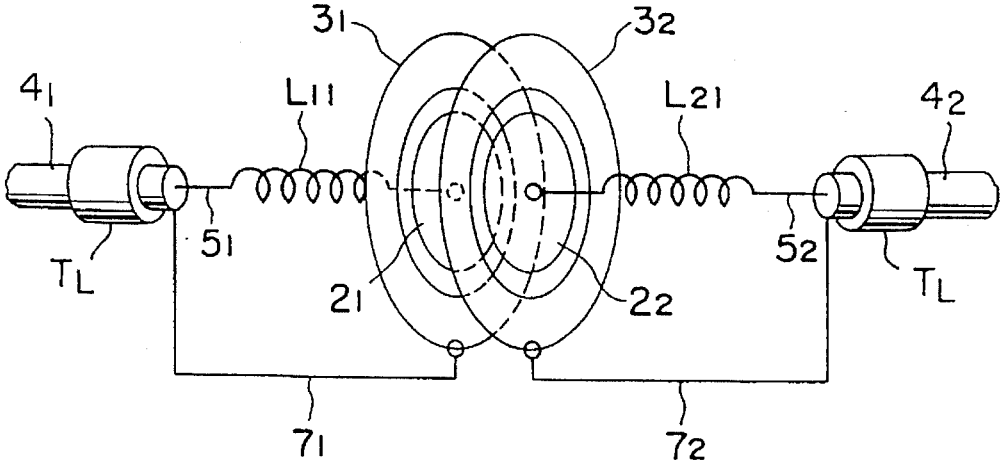
FIG. 7B is an explanatory view showing an electric equivalent circuit of the apparatus shown in FIG. 7A.

FIGS. 7A and 7B show an example of a coaxial cable coupling apparatus which reduces a current flowing in the outer conductor of the coaxial cable. In this example, a toroidal core $T_L$ is loaded on each of the coaxial cables $\mathbf{4}_1$ and $\mathbf{4}_2$ in the constitution shown in FIGS. 3A and 3B. Loading the toroidal core onto the coaxial cable makes a high impedance so as to suppress the current flowing in the outer conductor of the coaxial cable such as a Sperrtopf function of an antenna.

Figure 8:
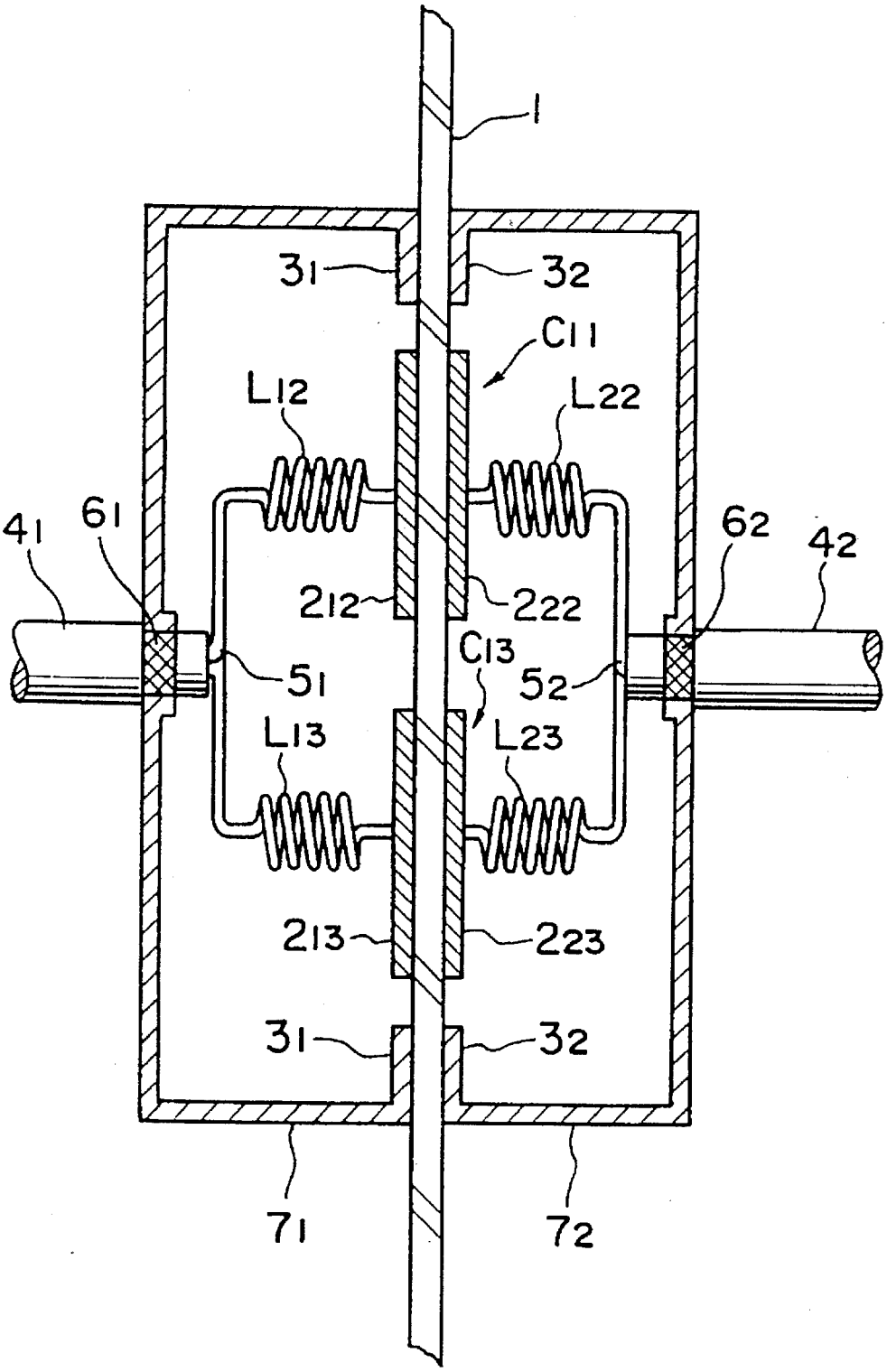
FIG. 8 is a sectional view showing an example of a coaxial cable coupling apparatus having a plurality of central electrodes.
Figure 10B:
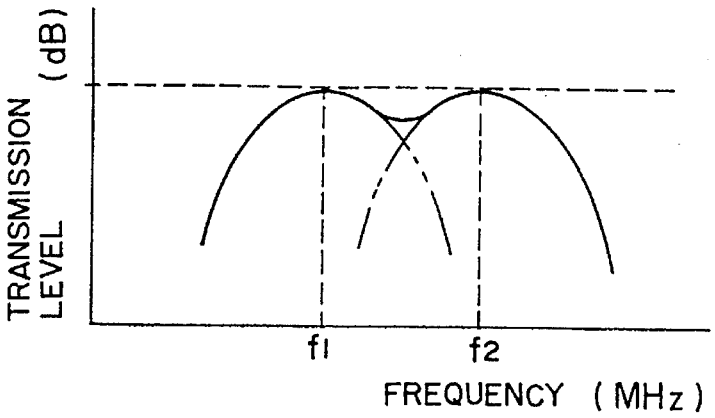

FIG. 8 shows an example of a coaxial cable coupling apparatus having a plurality of central electrodes. As portions in FIG. 8 corresponding to those in FIG. 3A are attached by the same numerals, a duplicated description will be omitted. In this apparatus, a first coupling capacitor $C_{12}$ and a second coupling capacitor $C_{13}$ are provided as a central electrode, in which the first capacitor $C_{12}$ comprises central electrodes $\mathbf{2}_{12}$ and $\mathbf{2}_{22}$ and the second capacitor $C_{13}$ and $C_{23}$. Inductor $L_{12}$ and $L_{22}$ are connected in series to the first coupling capacitor $C_{12}$, and an impedance constant is set in the manner that the coupling capacitor and the inductor perform a series resonance at a frequency $f_1$, for example. Inductor $L_{13}$ and $L_{23}$ are connected in series to the second coupling capacitor $C_{13}$, and an impedance constant is set in the manner that the coupling capacitor and the inductor perform a series resonance at a frequency $f_2$, for example. Such a condition causes a transmission route to be short circuit, which transmits a high frequency signal component of the frequency $f_1$ from the central conductor $\mathbf{5}_1$ through the inductor $L_{12}$, capacitor $C_{12}$ and inductor $L_{22}$ to the central conductor $\mathbf{5}_2$. Furthermore, a transmission route becomes short circuit, which transmits a high frequency signal component of the frequency $f_2$ from the central conductor $\mathbf{5}_1$ through the inductor $L_{13}$, capacitor $C_{13}$ and inductor $L_{23}$ to the central conductor $\mathbf{5}_2$. Therefore, the coaxial cable coupling apparatus having a plurality of the central electrodes obtains a multipletuning characteristic as shown in FIG. 10B by the comparatively simple constitution, thereby extending a signal transmission band width.

Figure 9:
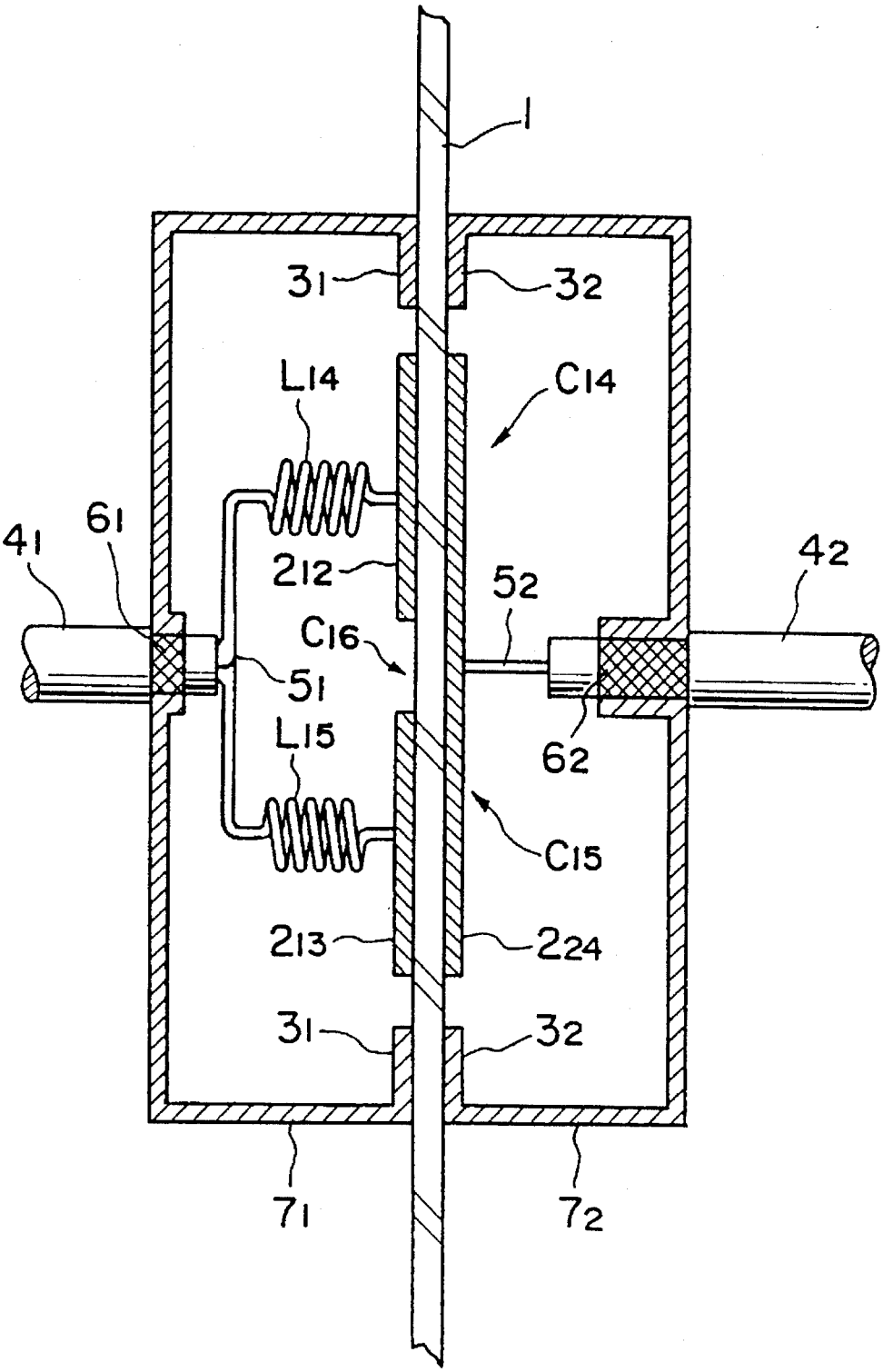
FIG. 9 is a sectional view showing an example of a coaxial cable coupling apparatus in which one central electrode opposes to a plurality of central electrodes through a glass plate.
Figure 10C:
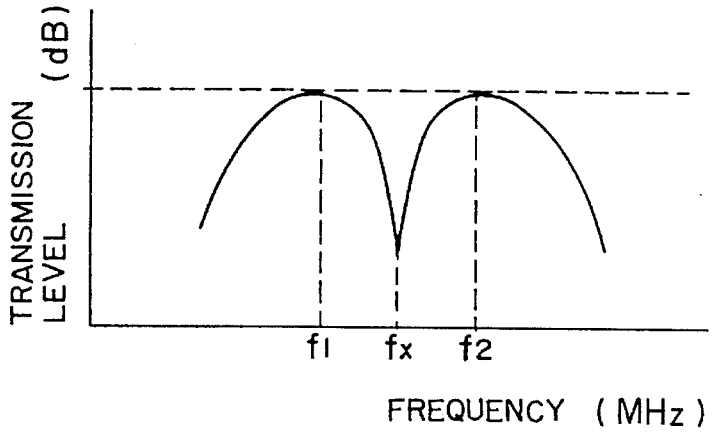

FIG. 9 shows an example of a coaxial cable coupling apparatus having a plurality of central electrodes on one surface of the glass plate and a single central electrode on the other surface of the glass plate. Portions in FIG. 9 corresponding to those in FIG. 8 are attached with the same numerals and a duplicated description is omitted. In this example, a coupling capacitor $C_{14}$ comprises an electrode $\mathbf{2}_{12}$ and a common electrode $\mathbf{2}_{24}$, and a coupling capacitor $C_{15}$ comprises an electrode $\mathbf{2}_{13}$ and a common electrode $\mathbf{2}_{24}$. The central conductor $\mathbf{5}_1$ on one side is connected to the capacitor $C_{14}$ through the inductor $L_{14}$, and to the capacitor $C_{15}$ through the inductor $L_{15}$. The central conductor $\mathbf{5}_2$ on the other side is connected to the common electrode $\mathbf{2}_{24}$. This configuration generates a parallel parasitic capacitance $C_{16}$ which is regarded as the cause of the difference of potentials between a connecting point of the inductor $L_{14}$ and capacitor $C_{14}$ and a connecting point of the inductor $L_{15}$ and capacitor $C_{15}$. As a result, it is possible to obtain a transmission characteristic (an anti-resonance frequency $f_X$) having partial band interruption characteristics within a wide signal transmission band as shown in FIG. 10C. Such characteristics can be applied to eliminate a strong interference wave and to interrupt passing a signal having a predetermined frequency.

Figure 11A:
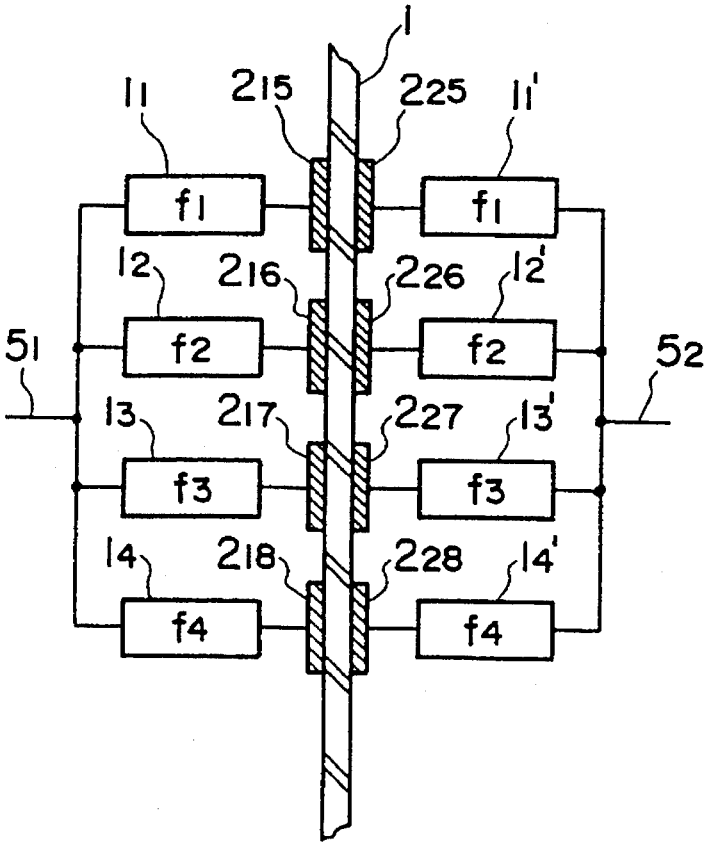
FIG. 11A is an explanatory view showing an example for causing passing signals to be wide band by a plurality of central electrodes.

FIG. 11A shows an example constituting a multiple tuning circuit in a coupling apparatus by using a plurality of central electrodes, in which only the central electrodes are shown and an outer electrode and outer conductor are eliminated. Other portions are the substantially same as the coupling apparatus shown in FIG. 8. In the example, the apparatus comprises first through fourth series resonance circuits. The first series resonance circuit comprises a coupling capacitor including the central electrodes $\mathbf{2}_{15}$ and $\mathbf{2}_{25}$, and matching circuits $\mathbf{1}_1$ and $\mathbf{1}_1'$ mainly configured from an inductor and serially resonating at a frequency $f_1$. The second series resonance circuit comprises a coupling capacitor including the central electrodes $\mathbf{2}_{16}$ and $\mathbf{2}_{26}$, and matching circuits $\mathbf{1}_2$ and $\mathbf{1}_2'$ mainly configured from an inductor and serially resonating at a frequency $f_2$. The third series resonance circuit comprises a coupling capacitor including the central electrodes $\mathbf{2}_{17}$ and $\mathbf{2}_{27}$, and matching circuits $\mathbf{1}_3$ and $\mathbf{1}_3'$ mainly configured from an inductor and serially resonating at a frequency $f_3$. And, the fourth series resonance circuit comprises a coupling capacitor including the central electrodes $\mathbf{2}_{18}$ and $\mathbf{2}_{28}$, and matching circuits $\mathbf{1}_4$ and $\mathbf{1}_4'$ mainly configured from an inductor and serially resonating at a frequency $f_4$.

Figure 11B:
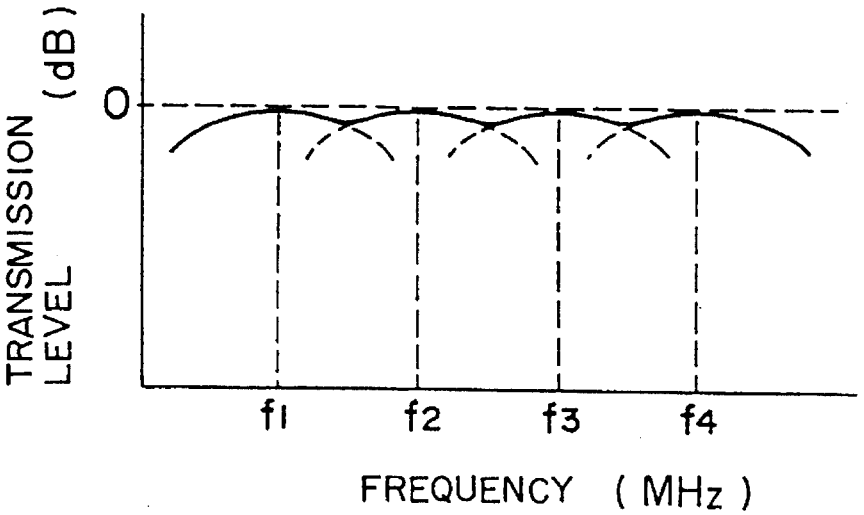
FIG. 11B is a graph showing a transmission characteristic corresponding to a frequency in the apparatus shown in FIG. 11A.

A transmission band characteristic, as shown in FIG. 11B, is in an extremely wide band which is generated by composing a plurality of band pass characteristics. Such the wide band characteristics is suitable for the case of coupling the transmission cables which transmit reception signals extending in a wide band such as a television broadcast and a frequency modulation (FM) radiobroadcast from an antenna to a tuner.

Figure 12A:
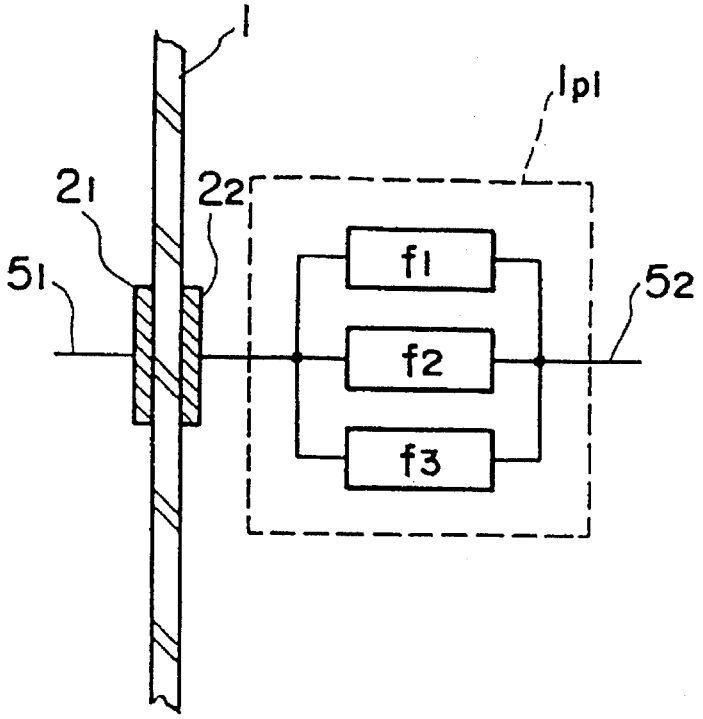
FIG. 12A is an explanatory view showing an example for causing passing signals to be wide band by connecting a central electrode with a complex matching circuit for matching by a plurality of frequencies.
Figure 12B:
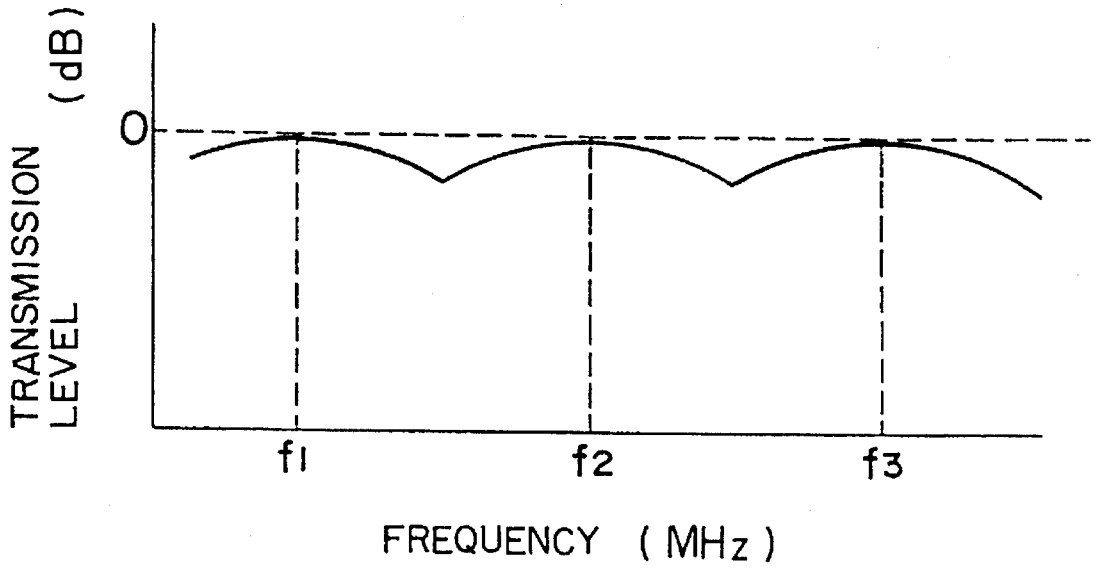
FIG. 12B is a graph showing a transmission characteristic corresponding to a frequency in the apparatus shown in FIG. 12A.

FIG. 12A shows an example of a coupling apparatus which connects one coupling electrode with a composite matching circuit $\mathbf{1}_{p1}$ having a plurality of multipletuned frequency. Such the constitution can obtain a wide band characteristic as shown in FIG. 12B. In this case, the tuning frequencies $f_1$, $f_2$, and $f_3$ and $f_4$ have a comparatively wide interval of frequencies, respectively, because these frequencies can generally and easily design a composite matching circuit. When the interval between the tuning frequencies is comparatively narrow, the constitution using a plurality of the electrodes on both sides shown in FIG. 11A makes a design be easy. The composite matching circuit $\mathbf{1}_{p1}$ can use not only the single matching circuit connected in series with the central electrode shown in FIG. 3A, but also both of the matching circuit shown in FIG. 3A and the matching circuit connected in parallel with the central electrode shown in FIG. 5A. When the single electrode and the composite matching circuit are used, there is an advantage that it is easy to miniaturize a matching circuit.

Figure 13:
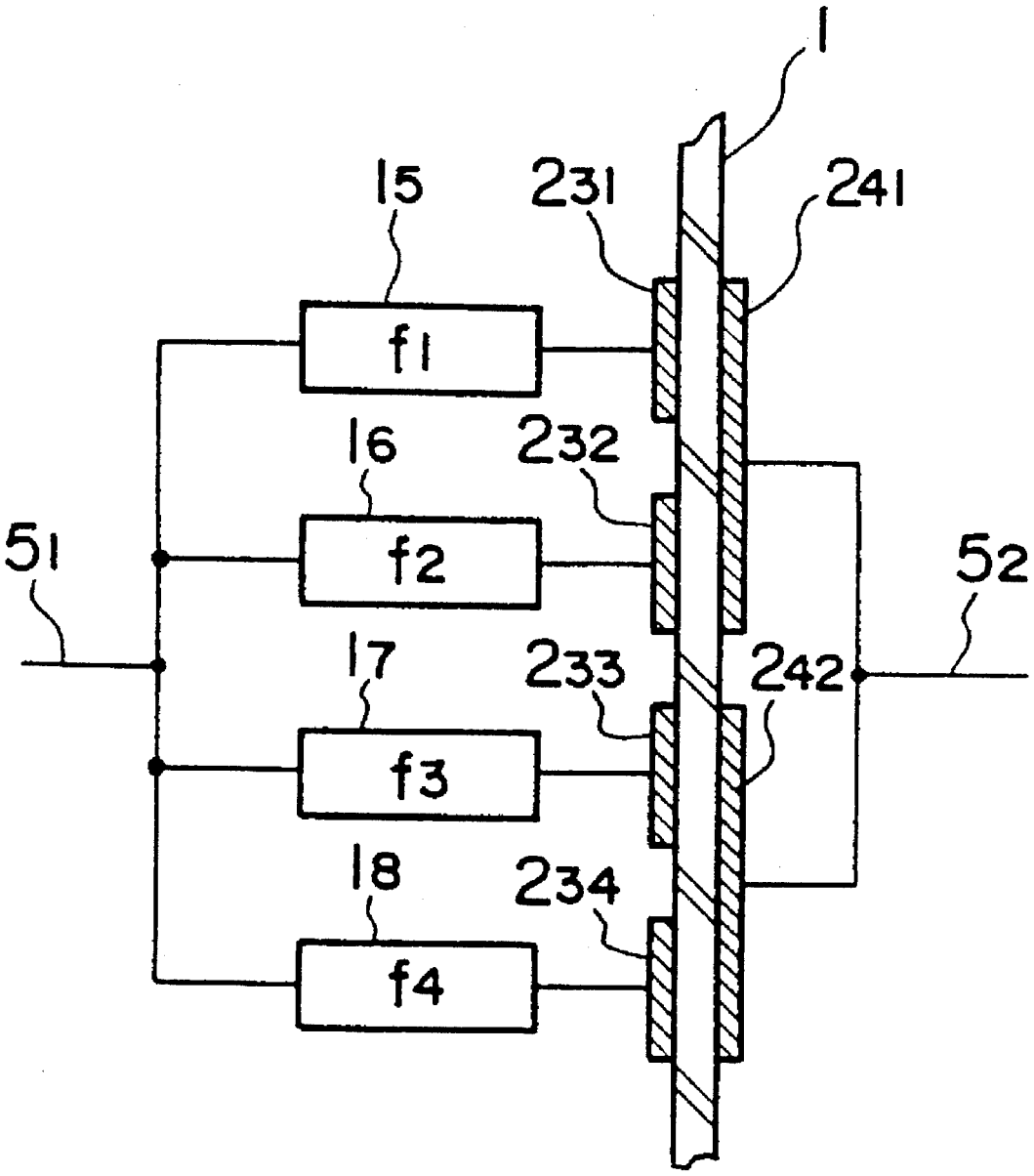
FIG. 13 is an explanatory view showing an example in which a plurality of constitutions each shown in FIG. 9 are provided.

FIG. 13 shows an example which combines two coupling apparatus with each other having band interrupting characteristics. Such the constitution can set a plurality of passing interruption frequencies within wide band transmission characteristics.

Figure 14:
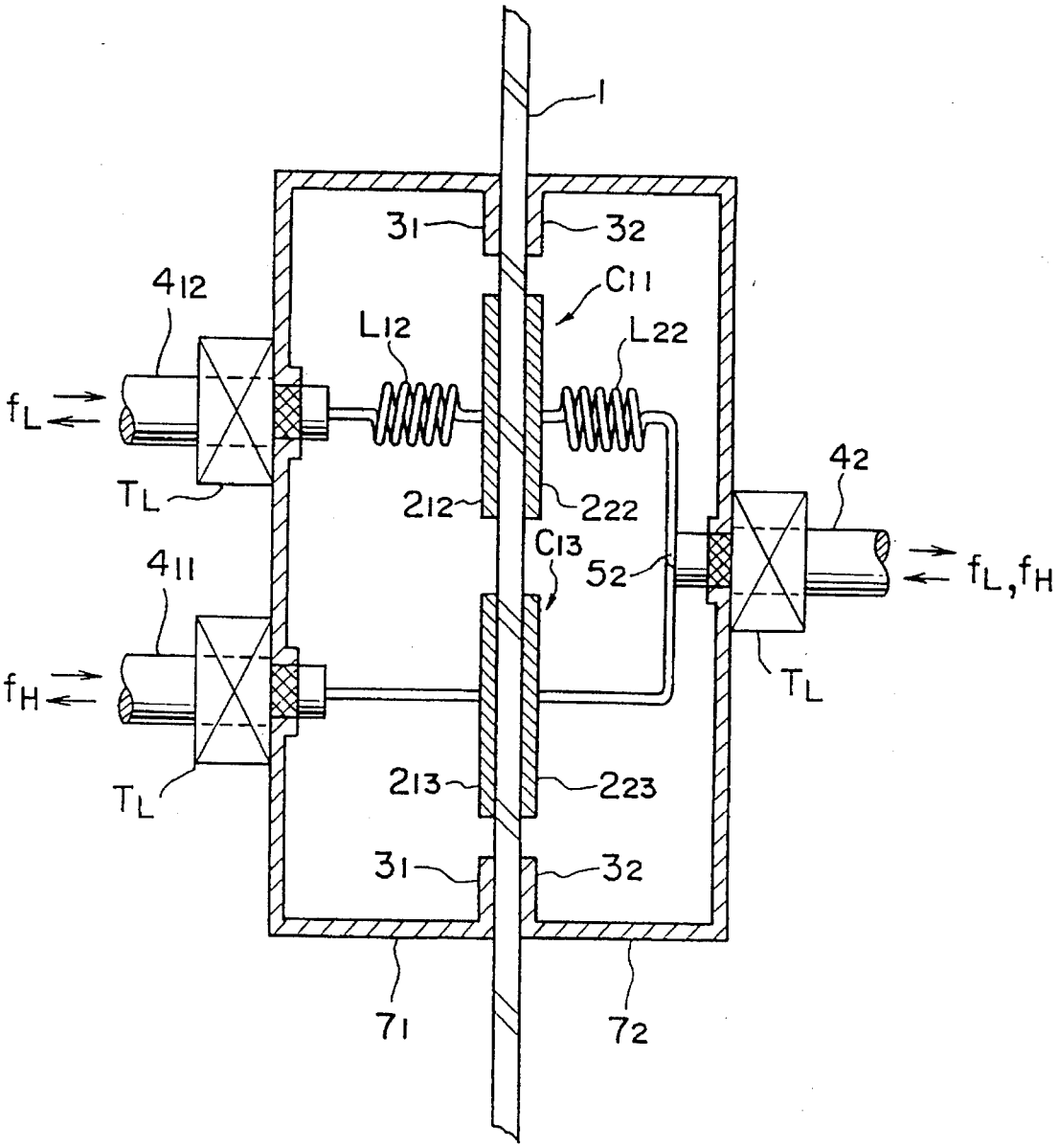
FIG. 14 is a sectional view showing an example of a coaxial cable coupling apparatus having a function as a diplexer.

FIG. 14 shows an example of a coaxial cable coupling apparatus including a function as a diplexer. Portions in FIG. 14 corresponding to those in FIG. 8 are attached with the same numerals, and a duplicated description is eliminated.

In FIG. 14, a transmission reception apparatus (receiver -not shown-) is connected to the coaxial cable $\mathbf{4}_2$, for example. The coaxial cable $\mathbf{4}_{12}$ is connected with an antenna (not shown) for receiving a low band. A coaxial cable $\mathbf{4}_{11}$ is connected with an antenna (not shown) for receiving a high frequency band. An inductor $L_{12}$, coupling capacitor $C_{11}$ and inductor $L_{22}$ form a band pass filter to interrupt a high band signal $f_H$ and to allow a low band signal $f_L$ passing through. A coupling capacitor $C_{13}$ forms a band pass filter to interrupt the low band signal $f_L$ and to allow the high band signal $f_H$ passing through. As a result, the coaxial cable coupling apparatus functions as a diplexer which receives two high-frequency signals $f_L$ and $f_H$ of low and high bands transmitted through the coaxial cable $4_2$ to distributes the low band signal $f_L$ to the coaxial cable $4_{12}$ and the high band signal $f_H$ to the coaxial cable $4_{11}$. The diplexer also transmits a composite signal of the low band high-frequency signal $f_L$ transmitted through the cable $4_{12}$ and the high band high-frequency signal $f_H$ transmitted through the cable $4_{11}$. In this portion, the toroidal core $T_L$ supports a part of suppression a current flowing into the outer conductor of the coaxial cable.

Figure 15A:
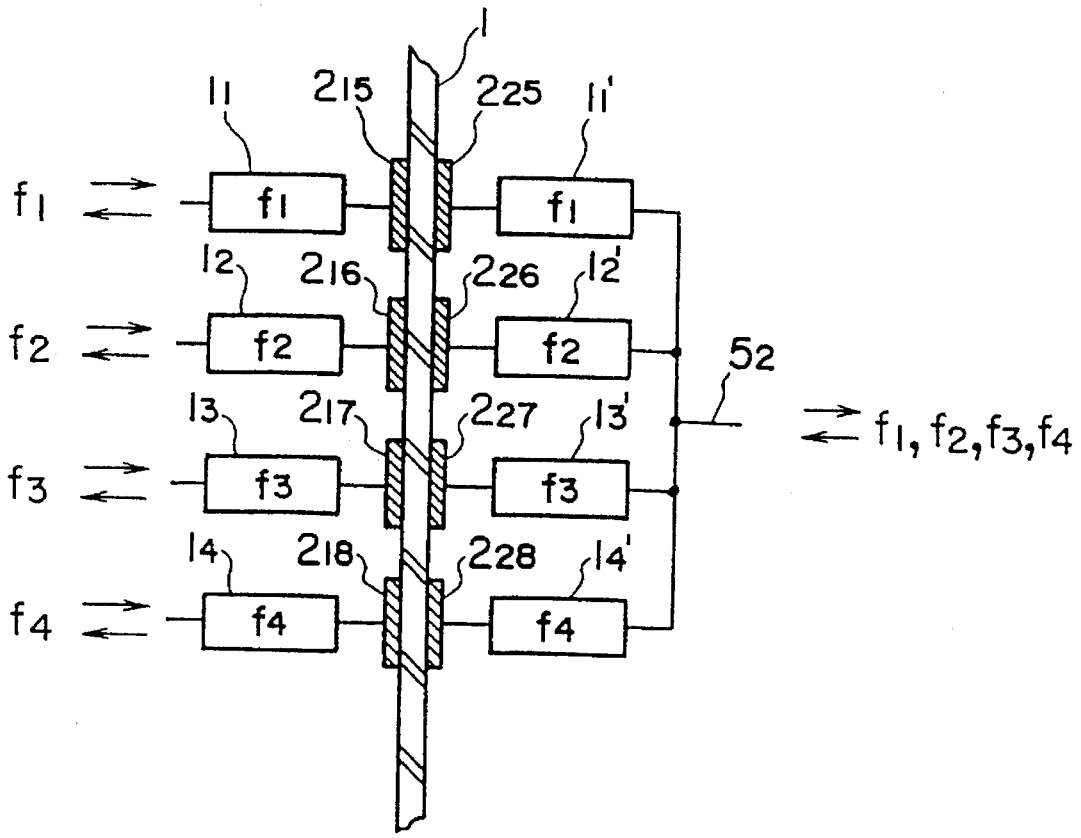
FIG. 15A is an explanatory view showing an example of a coaxial cable coupling apparatus having a plurality of central electrodes and matching circuits which function as a diplexer of a bandpass type.
Figure 15B:
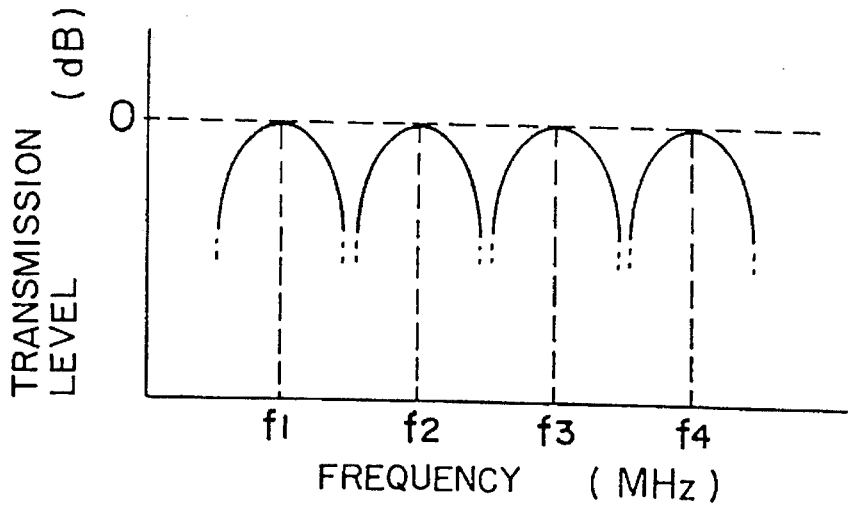
FIG. 15B is a graph showing a transmission characteristic corresponding to a frequency in the apparatus shown in FIG. 15A.

FIGS. 15A and 15B show an example in which a plurality of coaxial cables are connected to one coaxial cable by using a matching circuit having a plurality of band pass characteristics. FIG. 15A also shows only the circuit on the side of the central electrode in the same manner of the circuit shown in FIG. 11A and parts corresponding to those in FIG. 11A are attached with the same numerals. The apparatus of this example sets a higher quality factor Q of each matching circuit for serially resonating, as shown in FIG. 15B, thereby passing through only a specified frequency which is particularly set in each matching circuit. As a result, the signals having respective frequencies $f_1$, $f_2$, $f_3$ and $f_4$ and transmitted through the central conductor $5_2$ are distributed to the four coaxial cables. In contrast, the signals $f_1$, $f_2$, $f_3$ and $f_4$, which are transmitted through the four coaxial cables, are superposed to transmit to one coaxial cable.

Figure 16:
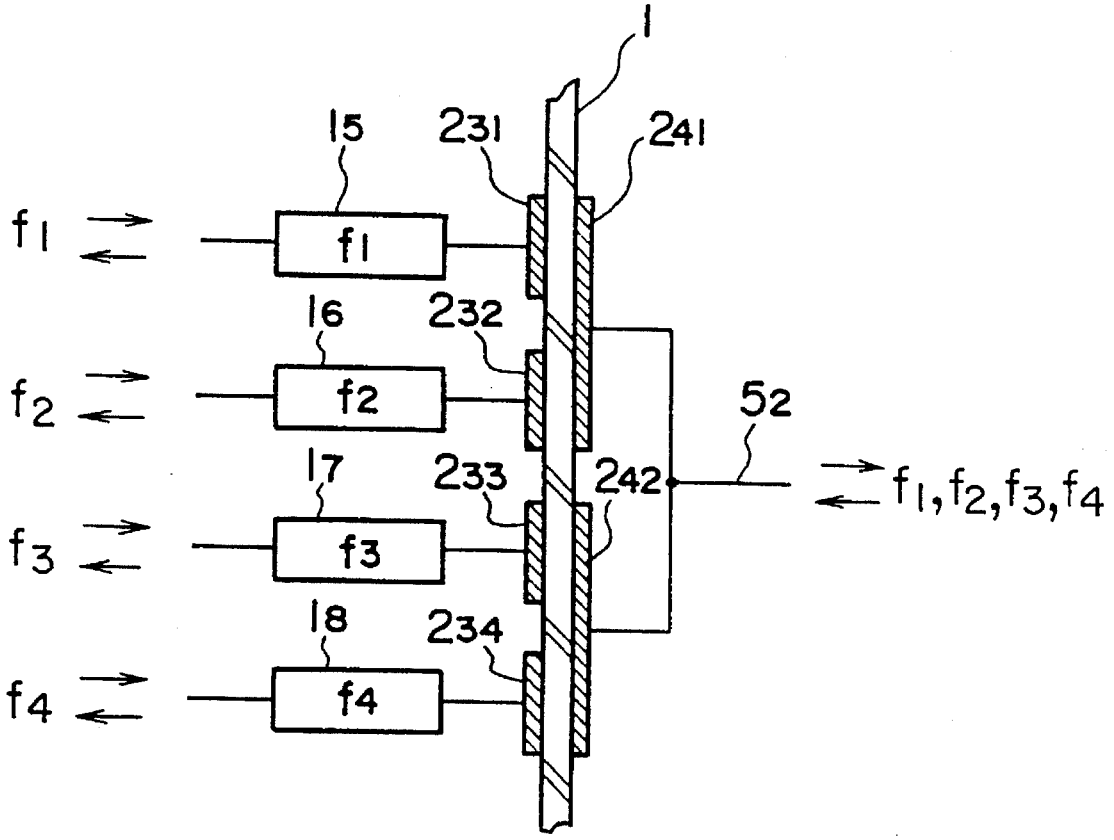
FIG. 16 is an explanatory view showing another example of the coaxial cable coupling apparatus functioning as a diplexer.

FIG. 16 shows an example in which the coaxial cable coupling apparatus shown in FIG. 13 supports a function as the diplexer. Parts in FIG. 16 corresponding to those in FIG. 13 are attached with same numerals. This example can interrupt signals having the other frequencies passing through by effectively using an anti-resonance characteristics having a comparatively higher quality factor Q as shown in FIG. 10C.

Figure 17:
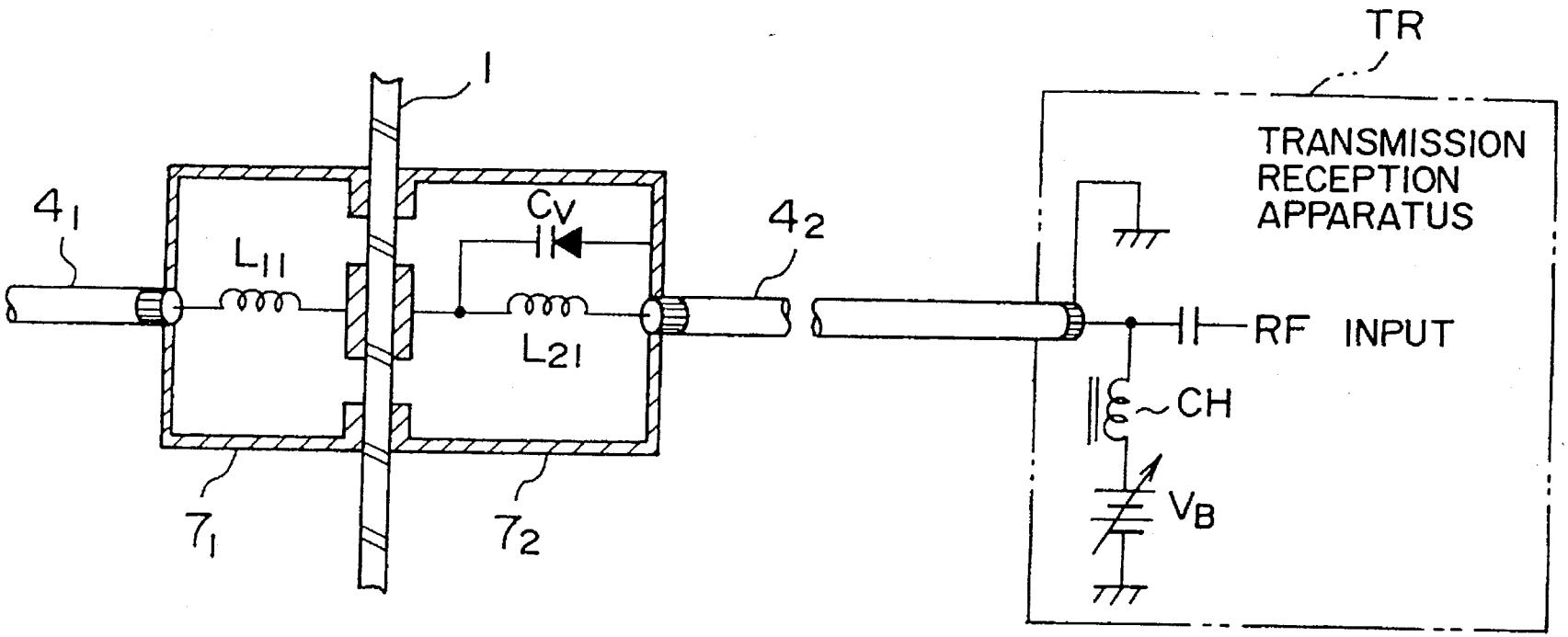
FIG. 17 is an explanatory view showing an example of a coaxial cable coupling apparatus having a variable matching circuit.

FIG. 17 shows an example in which a coaxial cable coupling apparatus comprises a matching circuit configured from a variable impedance circuit. Portions in FIG. 17 corresponding to those in FIG. 3A are attached with the same numerals. The matching circuit of this example has a variable capacitance element (for example, a variable capacitance diode) $C_V$ which is connected the central electrode and the outer conductor (outer electrode) in the coupling apparatus shown in FIG. 3A. In a portion on the side of the transmission reception apparatus TR, a variable DC voltage source $V_B$ is connected through a choke coil CH for interrupting a high frequency to the central conductor of the coaxial cable $4_2$ which will be connected to a high frequency (RF) input stage (not shown). When a voltage level of the variable voltage source $V_B$ changes, a DC bias level of the variable capacitance element $C_V$ changes so as to change a tuning frequency of the matching circuit. Accordingly, it is possible to adjust passing frequency characteristics of the coaxial cable coupling apparatus on the side of the transmission reception apparatus TR.

Figure 18:
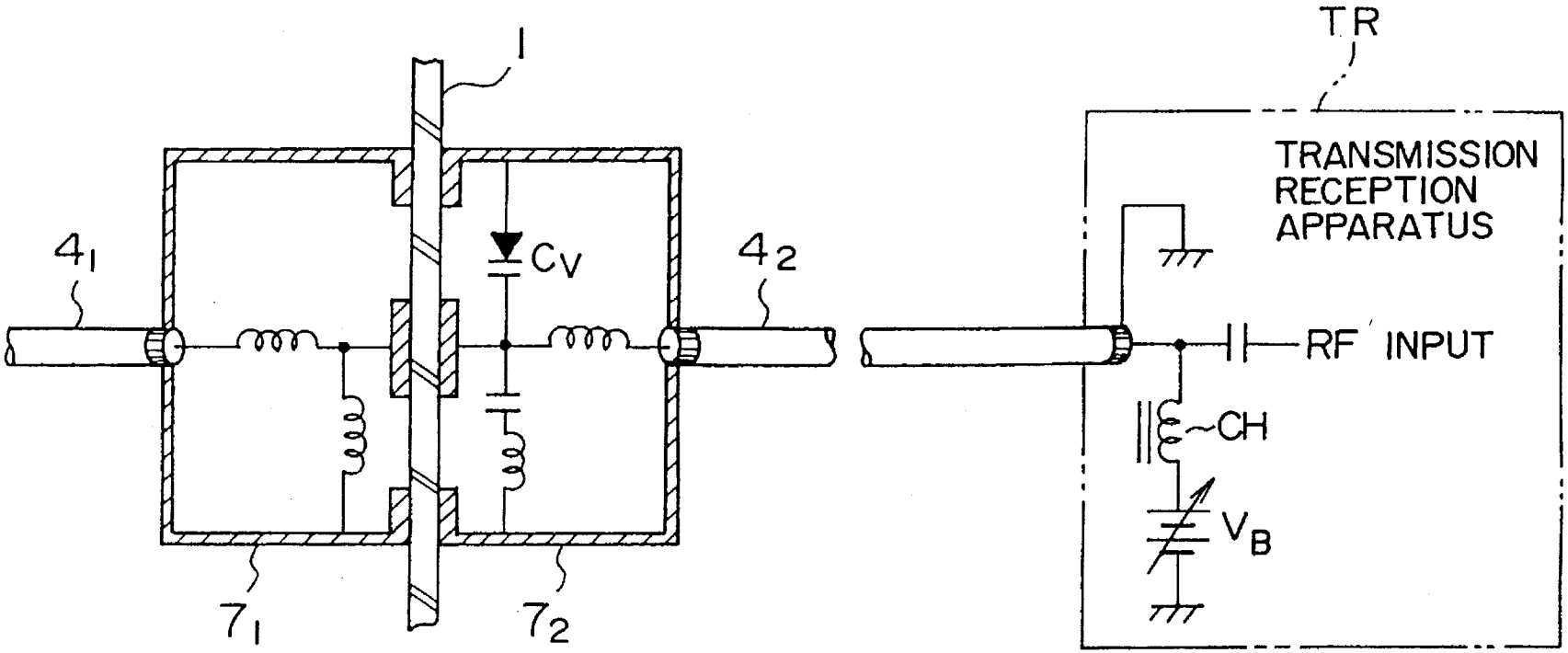
FIG. 18 is an explanatory view showing another example of a coaxial cable coupling apparatus having a variable matching circuit.

FIG. 18 shows another example in which a matching circuit of the coaxial cable coupling apparatus has a variable characteristic. Portions in FIG. 18 corresponding to those in FIG. 17 are attached with the same numerals. In this configuration, when a voltage level of the variable DC voltage source changes to be set on the side of the transmission reception apparatus, the DC bias level of the variable capacitance element $C_V$ changes, thereby causing the tuning frequency characteristics, namely transmission band characteristics of the coaxial cable coupling apparatus to be changed.

Figure 19:
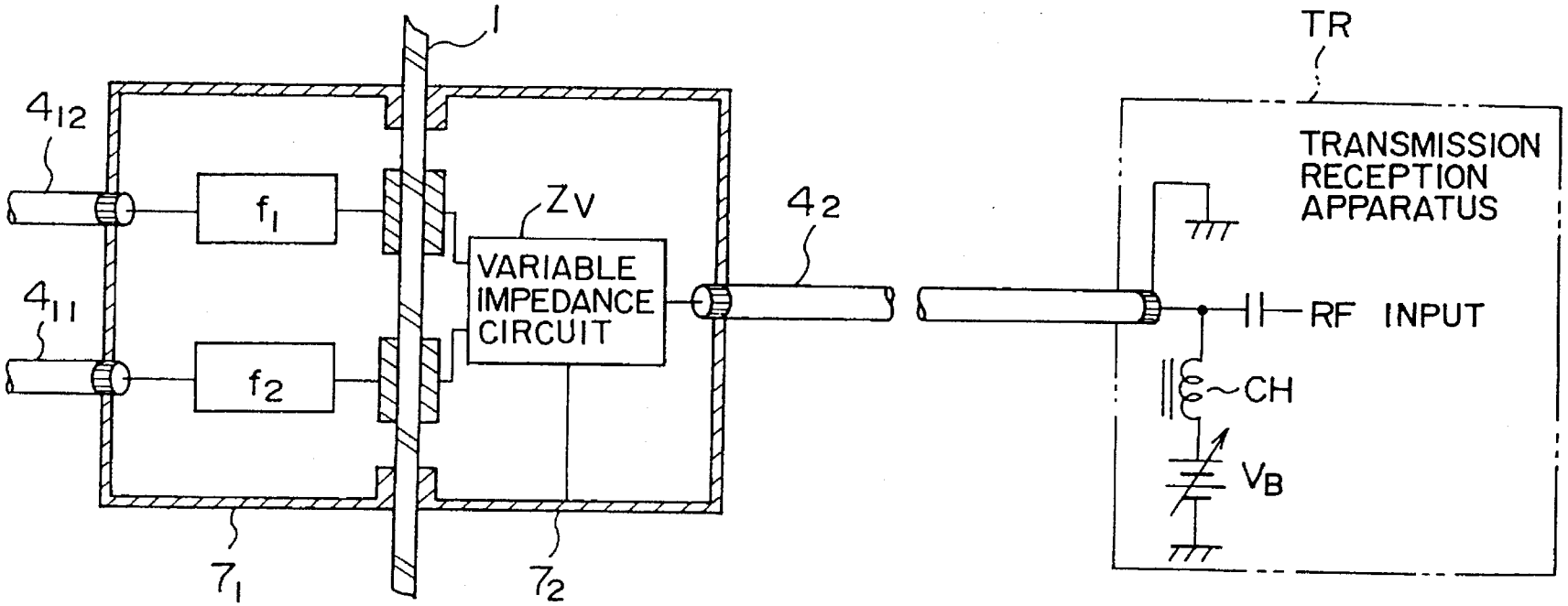
FIG. 19 is an explanatory view showing an example of a coaxial cable coupling apparatus having a variable matching circuit which functions as a diplexer.

FIG. 19 shows an example in which a variable impedance circuit $Z_V$ is provided in the coaxial cable coupling apparatus including a plurality of central electrodes and a diplexer function.

This example comprises a first matching circuit having band pass characteristics for the frequency $f_1$, a second matching circuit having band pass characteristics for the frequency $f_2$, a variable impedance circuit $Z_V$ having a band pass characteristics capable of variably setting a frequency of the passing signal. It is possible to select the signal $f_1$ and $f_2$ by changing the set of the variable DC voltage source $V_B$ on the side of the transmission reception apparatus TR in the manner that a transmission frequency characteristic of the variable impedance circuit $Z_V$ becomes to be the signal $f_1$ or $f_2$.

Figure 20:
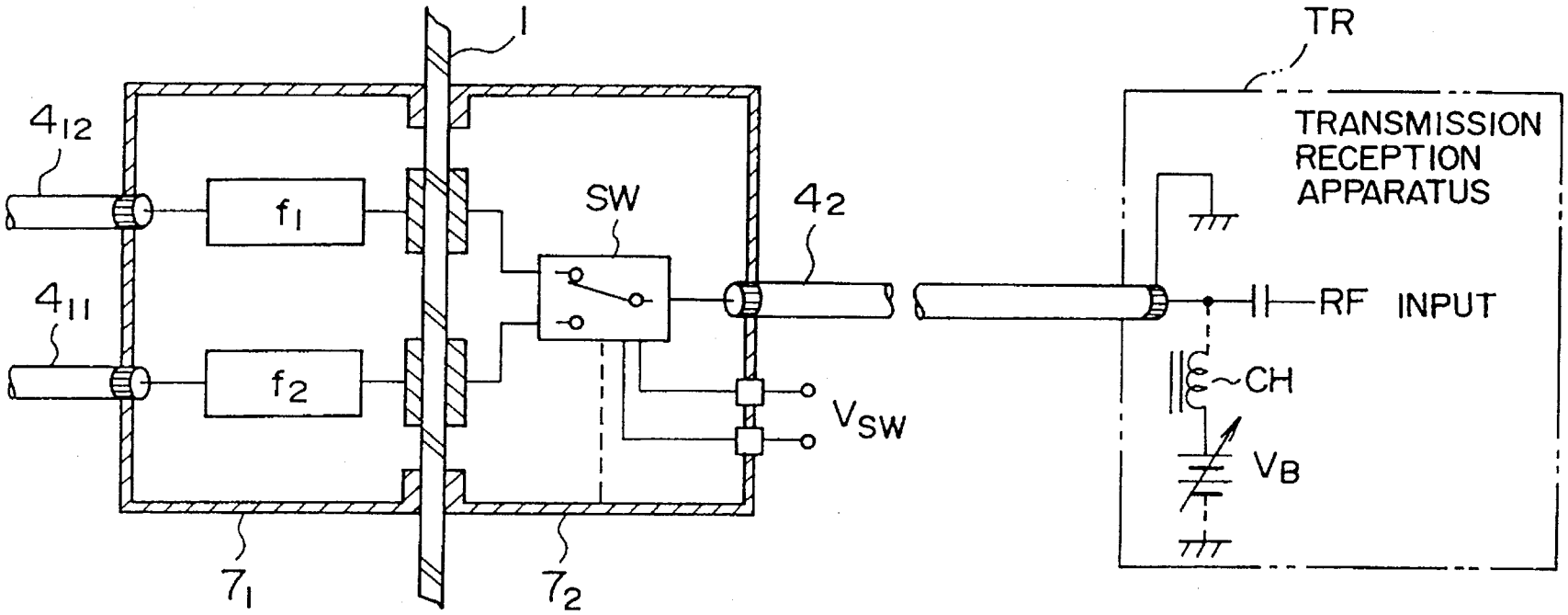
FIG. 20 is an explanatory view showing an example of a coaxial cable coupling apparatus having an electronic switch SW which functions to change over a connection of coaxial cables.

FIG. 20 shows an example in which a electronic changeover switch SW provided in the coaxial cable coupling apparatus connects any one of the coaxial cable $4_{11}$ and $4_{12}$ with the coaxial cable $4_2$. A control of the changeover switch SW is performed by introducing a control line from the changeover switch SW to the outside of the metallic shield member $7_2$ and adding the voltage $V_{SW}$ supplied from the outside. Furthermore, it is also possible to operate the changeover switch SW corresponding to a level of the DC voltage $V_B$ which is superposed onto the central conductor of the coaxial cable, as shown by a dotted line in the figure.

Figure 21:
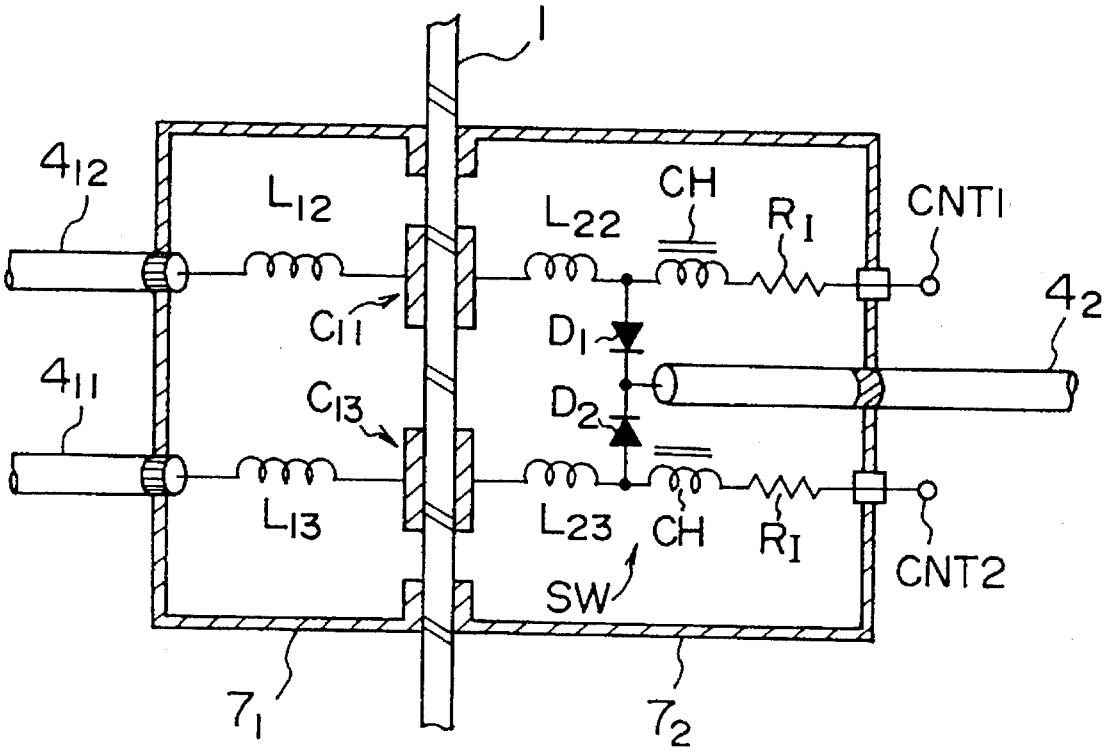
FIG. 21 is a circuit diagram showing an example in which an electronic switch SW is controlled by an external control voltage.

FIG. 21 shows an example for externally controlling the changeover switch SW. In this figure, symbols $L_{12}$, $L_{13}$, $L_{22}$ and $L_{23}$ are matching inductances, $C_{11}$ and $C_{13}$ are coupling capacitors formed by the central electrodes, $D_1$ and $D_2$ are diodes for switching, CH is a choke coil for interrupting a high frequency, and $R_I$ is a current limit resistor, respectively. The changeover switch SW comprises the current limit resistor $R_I$, the choke coil CH, the diodes $D_1$ and $D_2$ in which both anodes are interconnected with each other, the choke coil CH and the current limit resistor $R_I$, which are connected in series between control terminals CNT1 and CNT2.

When the voltage $V_{SW}$ is supplied between the control terminals CNT1 and CNT2 in the manner that the diode $D_1$ is biased in the regular direction and the diode $D_2$ is biased in the opposite direction, the diode $D_1$ is turned on and the diode $D_2$ is turned off, thereby connecting the central conductor of the coaxial cable $4_2$ with the central conductor of the coaxial cable $4_{12}$ through the diode $D_1$, inductor $L_{22}$, capacitor $C_{11}$ and inductor $L_{12}$.

When the voltage $V_{SW}$ is supplied between the control terminals CNT1 and CNT2 in the manner that the diode $D_1$ is biased in the opposite direction and the diode $D_2$ is biased in the regular direction, the diode $D_1$ is turned off and the diode $D_2$ is turned on, thereby connecting the central conductor of the coaxial cable $4_2$ with the central conductor of the coaxial cable $4_{11}$ through the diode $D_2$, inductor $L_{23}$, capacitor $C_{13}$ and inductor $L_{13}$.

In such a manner, it is possible to change over the connection of the coaxial cable in the coaxial cable coupling apparatus.

Figure 22:
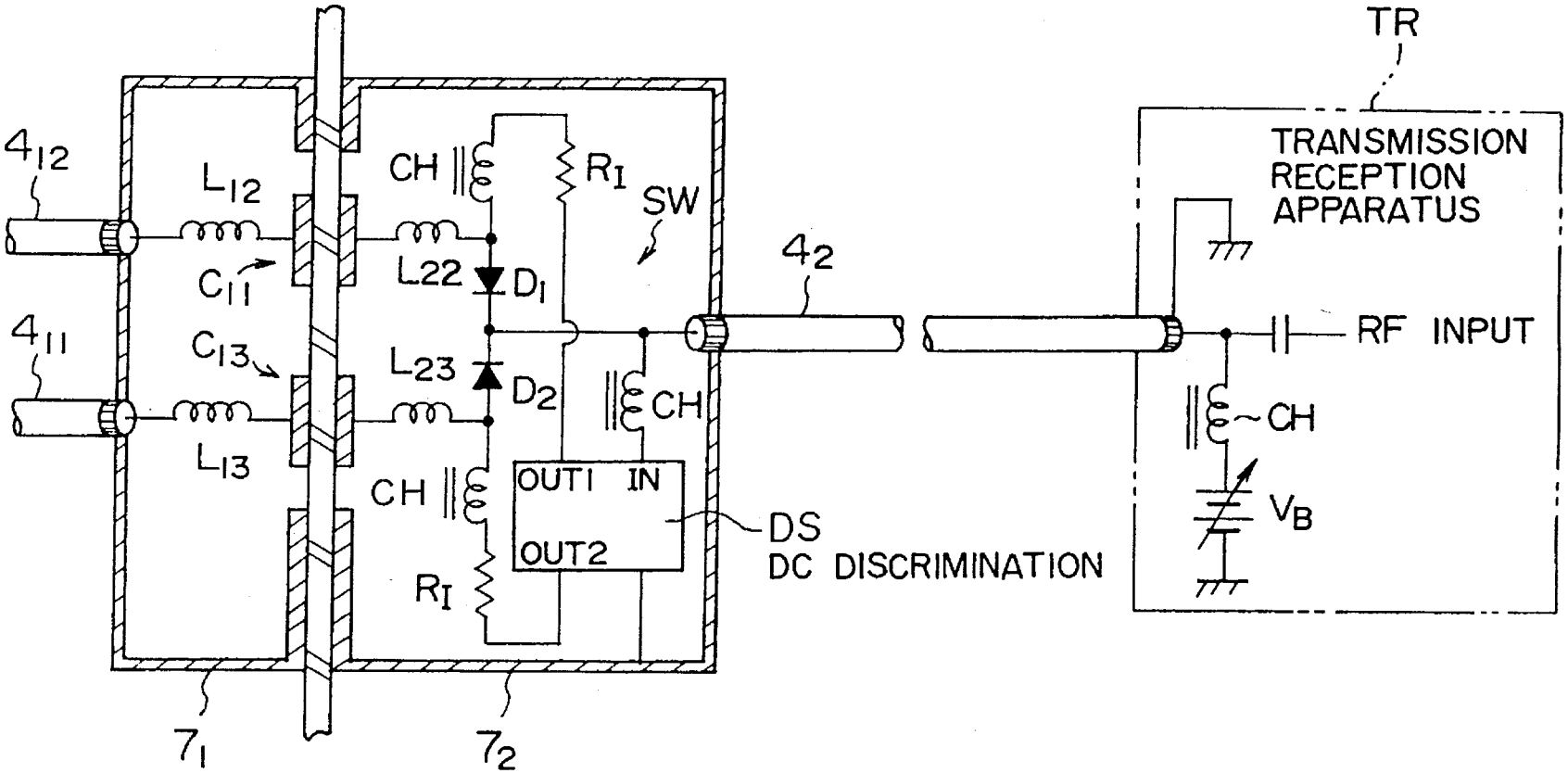
FIG. 22 is a circuit diagram showing an example in which an electronic switch SW is controlled by a superposed voltage to a coaxial cable.

FIG. 22 shows an example for controlling the changeover switch SW from the side of the transmission reception apparatus TR. Since portions in this figure corresponding to those in FIG. 21 are attached with the same numerals, duplicated description is omitted. In this configuration, a variable voltage source $V_B$ is connected through the choke coil for interrupting a high frequency to the central conductor of the coaxial cable $4_2$ on the side of the transmission reception apparatus. A DC separation circuit DS is connected to the central conductor of the coaxial cable $4_2$ on the side of the coaxial cable coupling apparatus through the choke coil for interrupting a high frequency. The DC separation circuit obtains a circuit power source in the manner that an inner circuit smooths a DC component which is separated by the choke coil. The DC separation circuit DS comprises a window comparator. When 5–10 volts are supplied to an input terminal IN of the window comparator, the DC separation circuit DS outputs 5 volts with an output terminal OUT1 and 0 volt with an output terminal OUT2. When 10–15 volts are supplied to the input terminal IN, the output terminal OUT1 is 0 volt and the output terminal OUT2 outputs 5 volts. Both ends of the series circuit ($R_I$, CH, $D_1$, $D_2$, CH and $R_I$) constituting the changeover switch are connected to the output terminals OUT1 and OUT2.

As a result, when 6 volts of the DC bias voltage from the variable voltage source $V_B$ is superposed to the central conductor of the coaxial cable $4_2$, the DC separation circuit DS turns on the diode $D_1$ and turns off the diode $D_2$, thereby connecting the central conductor of the coaxial cable $4_2$ to the central conductor of the coaxial cable $4_{12}$. When 12 volts of the DC bias voltage are superposed to the central conductor of the coaxial cable $4_2$ from the variable voltage source $V_B$, the DC separation circuit DS turns off the diode $D_1$ and turns on the diode $D_2$, thereby connecting the central conductor of the coaxial cable $4_2$ to the central conductor of the coaxial cable $4_{11}$.

Accordingly, it is possible to change the antenna to be used by changing over the connection of the coaxial cables on the side of the transmission reception apparatus TR. Such a configuration is suitable for a diversity reception system in which the antennas are automatically changed over corresponding to a condition for receiving a radio wave.

Figure 23A:
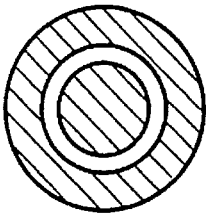
FIGS. 23A–23E are explanatory views respectively showing examples of various kinds of shapes of a central electrode and outer electrode.
Figure 23B:
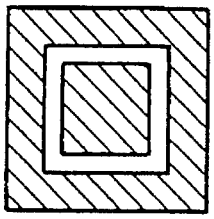
Figure 23C:
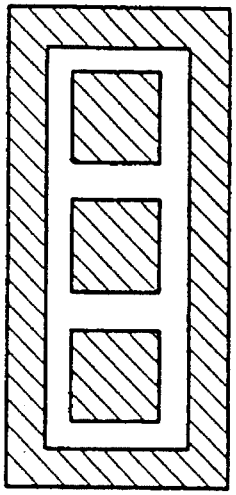
Figure 23D:
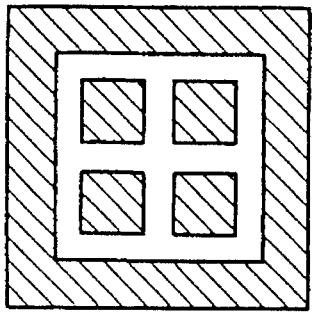
Figure 23E:
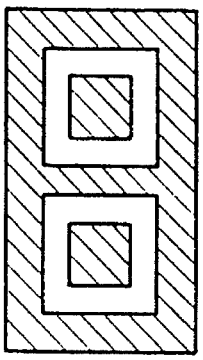

FIGS. 23A-2E show various examples with respect to shapes of the coupling electrodes realizing a coaxial transmission mode. FIG. 23A shows a coaxial arrangement of the disc-shaped central electrode and the ring-shaped outer electrode. FIG. 23B shows a coaxial arrangement of the central electrode having a polygonal shape and the outer electrode having a frame shape surrounding the central electrode. FIG. 23C shows an arrangement of a plurality of central electrodes arranged in one line and an outer electrode surrounding the central electrodes. FIG. 23D shows an arrangement of a plurality of central electrodes arranged in a matrix shape and an outer electrode surrounding the central electrodes. FIG. 23E shows an arrangement of two central electrodes arranged in parallel and an outer electrode surrounding the central electrodes including an intermediate portion of the central electrodes, thereby enabling a complete shield between a plurality of electrodes. Even though there is not shown in the figure, the outer electrode surrounding the central electrode may be formed in a spiral. Also, a circular outer electrode may be divided in a plurality of planes and these planes are connected with each other with a wire. The selection for the electrode shape and arrangement can be determined after a synthetic judgment for a size of the apparatus, formation of coupling, mounted portions of the apparatus and the like.

Figure 24A:
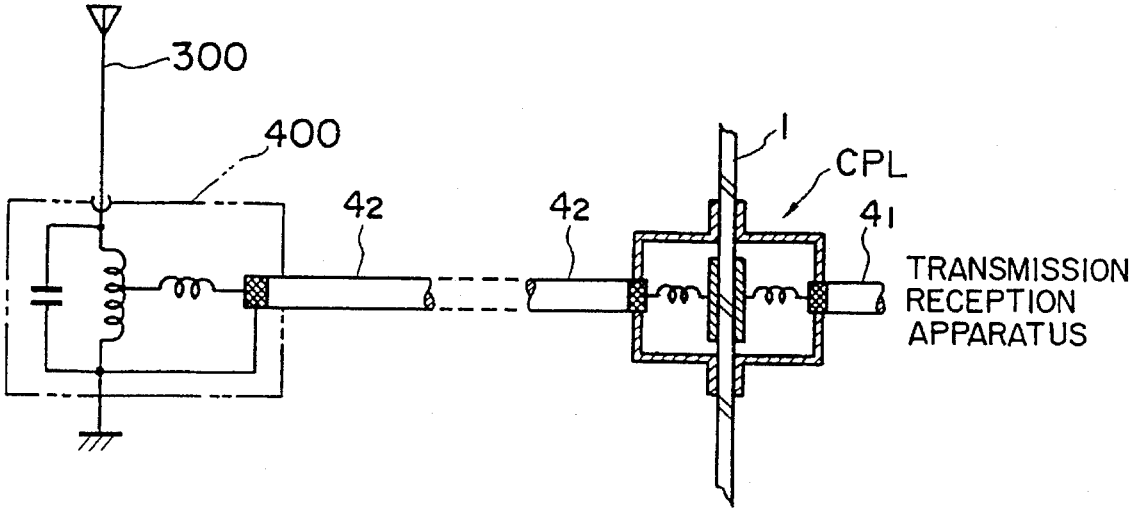
FIG. 24A is an explanatory view showing an example for using a coaxial cable coupling apparatus.

FIG. 24A shows an example of an antenna system for applying a coaxial cable coupling apparatus of the present invention. A system shown in FIG. 24A comprises a coaxial cable $4_1$ which is provided on an interior side and connected to a not-shown transmission reception apparatus provided in a cabin or room as a closed space, a coupling apparatus CPL of a coaxial cable fixed to a glass plate 1 of a window, a coaxial cable $4_2$ on an exterior side, an antenna 300 and a matching circuit 400 which is connected between the cable $4_2$ and the antenna 300 to take a matching therebetween. The matching circuit 400 comprises a transducer, inductor and capacitor for matching an impedance.

Figure 24B:
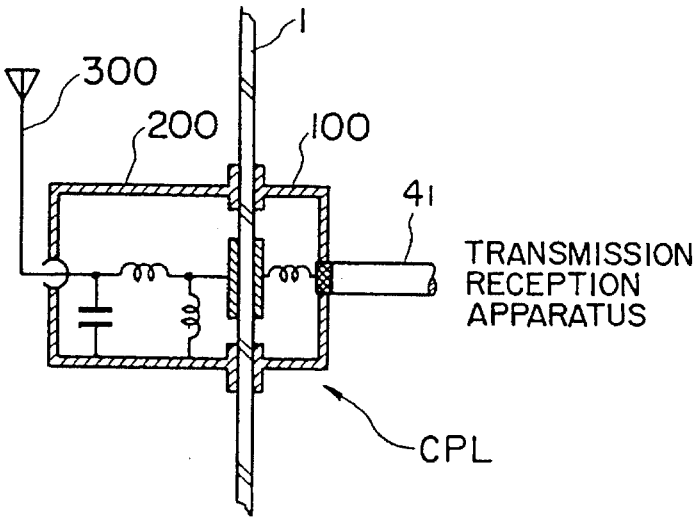
FIG. 24B is an explanatory view showing an example constituting an antenna system by using the coaxial cable coupling apparatus shown in FIG. 24A.

FIG. 24B shows an example for constituting in one body a coaxial cable coupling apparatus CPL and an antenna 300. An interior coupling apparatus 100 constituting the coupling apparatus CPL is connected with a coaxial cable $4_1$, while an exterior coupling apparatus 200 of the coupling apparatus CPL is connected with the antenna 300. Furthermore, there is provided a matching circuit in the exterior coupling apparatus 200 in order to take a matching with the coupling electrode and a matching between the coupling electrode and the antenna. Since this configuration supplies a high frequency power in a coaxial mode from the interior coaxial cable inside the glass plate to the external side of the glass plate, it is possible to obtain antenna systems only having a little loss.

Figure 25:
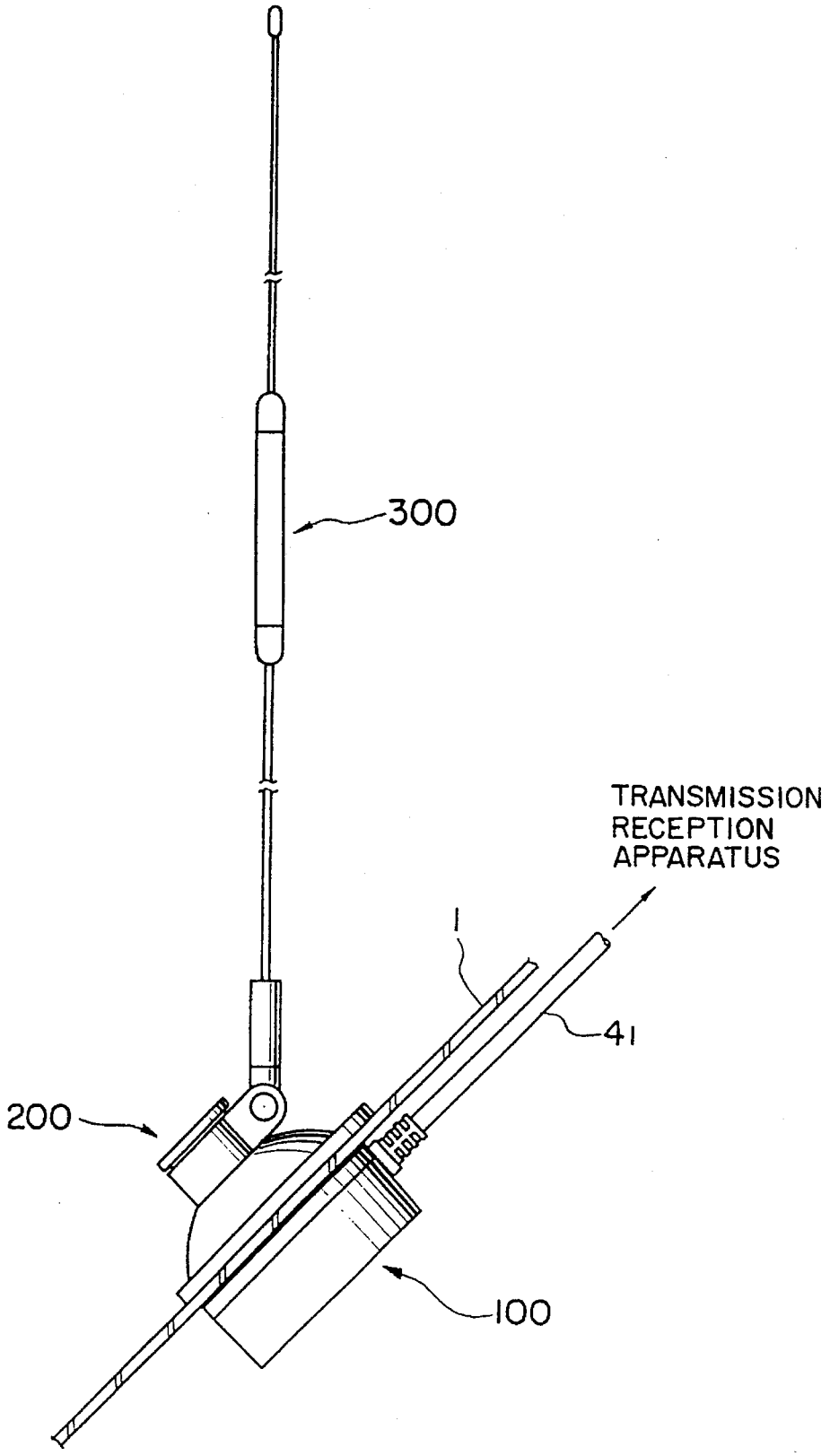
FIG. 25 is an explanatory view showing a constitution example of the antenna system according to the present invention.
Figure 26:
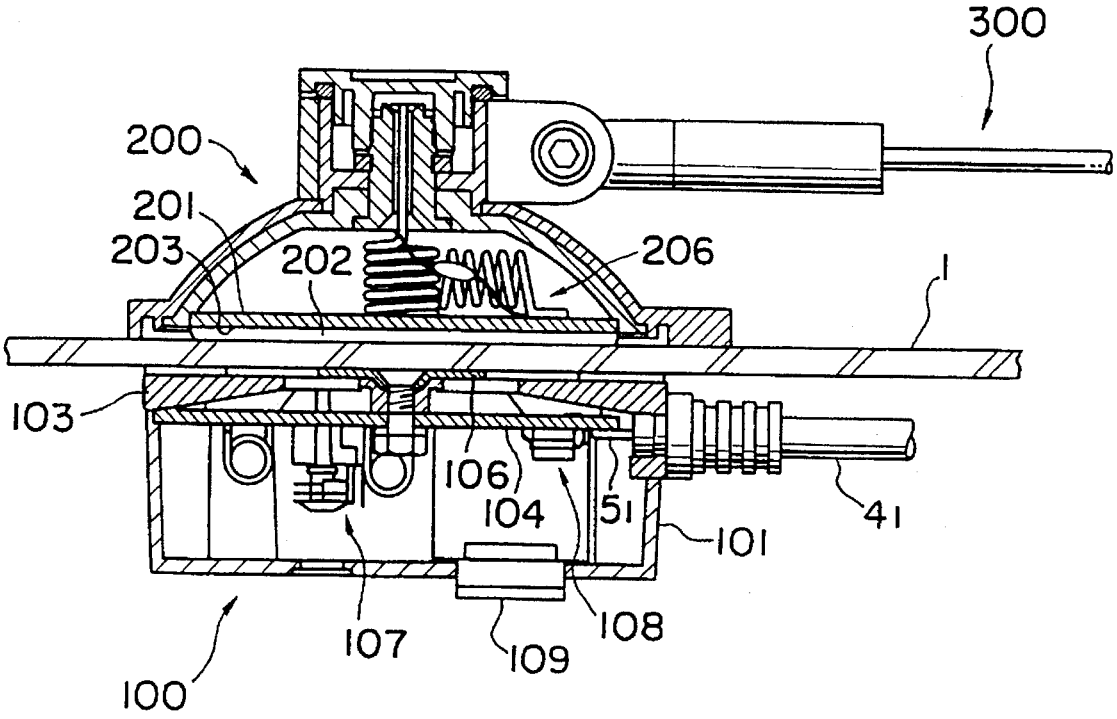
FIG. 26 is a sectional view showing the antenna system shown in FIG. 25.

There is described more detailed embodiment of an antenna system for transmitting and receiving a high frequency signal while maintaining a coaxial transmission mode inside and outside the glass (dielectric) plate with reference to FIG. 25 and FIG. 26 (which is a sectional view of FIG. 25). In both figures, there is a cabin or room under the glass plate 1, and there is an exterior of the vehicle or room over the glass plate 1. An interior coupling apparatus 100 is provided on an undersurface of the glass plate 1 by means of, for example, a double-adhesive-faced tape. An exterior coupling apparatus 200 is fixed on the position opposite to the interior coupling apparatus 100 on the upper surface of the glass plate 1 by means of double-adhesive-faced tape and is connected to a whip antenna 300. The interior and exterior coupling apparatus 100 and 200 is a device for electrically connecting a high frequency signal by a capacitive coupling of the coaxial mode described above. This connection is done by a central electrode 106 and an outer electrode 103 of the interior coupling apparatus 100 and a central electrode 202 and an outer electrode 203 which are formed on an undersurface of a circuit board 201 of the exterior coupling apparatus 200. There are provided matching circuits 107 and 206 in the interior and exterior coupling apparatus 100 and 200, respectively, to be the shortest of the loss at a design frequency. The matching circuit 107 is comprised of a variable matching circuit to be adapted for various kinds of glass. In order to easily regulate the matching circuit, there are provided a detection circuit 108 for detecting a matching condition and a meter 109 for displaying a detection result. The whip antenna 300 is connected through the exterior coupling apparatus 200, interior coupling apparatus 100 and coaxial cable $4_1$ to a not-shown mobile radio telephone (communication) system, thereby performing a radio communication. There will be described more detail the interior and exterior coupling apparatus 100 and 200 constituting an antenna system.

Figure 27A:
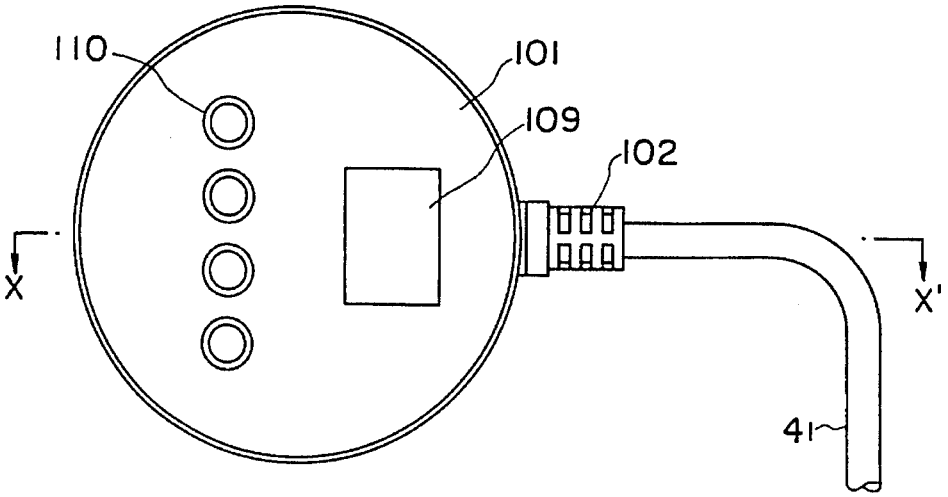
FIG. 27A is a plane view showing an appearance of an inner coupling apparatus constituting the antenna system.
Figure 27B:
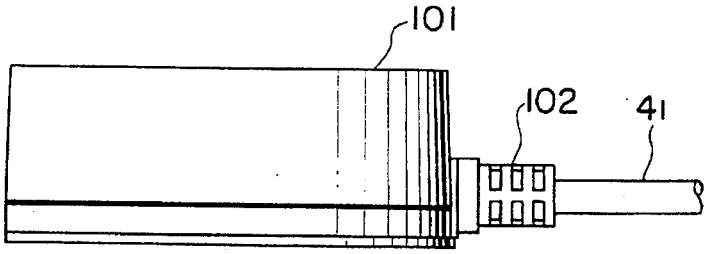
FIG. 27B is a side view showing the inner coupling apparatus.
Figure 27C:
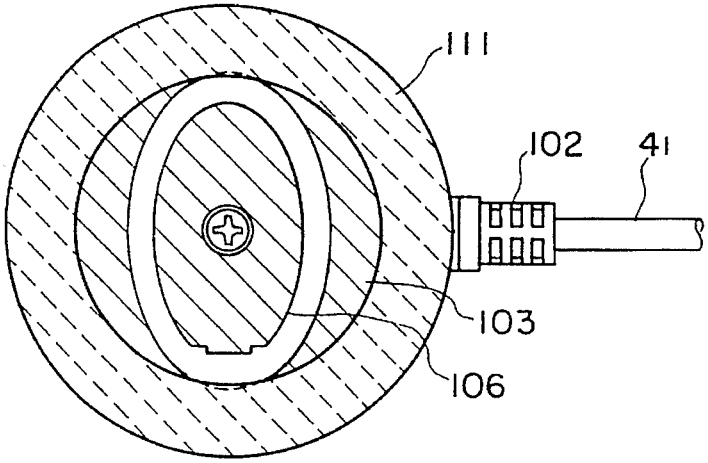
FIG. 27C is a base view showing the inner coupling apparatus.

FIGS. 27A–27C show an appearance of the interior coupling apparatus (which is shown upside-down with the attached condition shown in FIG. 26), in which FIG. 27A is a plan view, FIG. 27B is a side view and FIG. 27C is a base view. A case 101 is a metallic case serving as a shield and having a cylindrical shape, in which a hole 110 opens at a center or left portion on the upper surface in order to adjust a variable capacitor in the interior variable matching circuit, and a meter 109 is provided at a center or right portion on the upper surface to direct a matching condition. The meter 109 can be chosen corresponding to a requirement for displaying a feed through power, a reflected wave power, a standing wave ratio —SWR—, and the like. A coaxial cable $4_1$ is connected to under portion of the case 101 by a connector 102. An outer electrode 103 is arranged on a bottom surface of the case 101 in the manner of surrounding a central electrode 106 which is also arranged on the bottom surface of the case 101. In this embodiment, the central electrode 108 is formed in an elliptic shape because of avoiding a heat wire buried in the glass plate and obtaining a sufficient electrode area as a necessary capacitance. Several advantages are provided for preventing a noise interference from an engine into a radio apparatus or from a radio apparatus into a mobile computer circuit, and for preventing a fault of a matching. Furthermore, the central electrode 106 may be formed in a rectangular shape, and it is possible to modify in various shapes within a scope of maintaining the coaxial transmission mode as shown in FIG. 23, for example. A ring shape double-adhesive-surface tape is sticked around the peripheral surface of the outer electrode 103 on the glass plate in order to fix the inner coupling apparatus 100. Other simple methods of fixing the coupling apparatus may be used. For example, the inner coupling apparatus 100 may be fixed to the glass plate i by using an adhesive agent.

Figure 28:
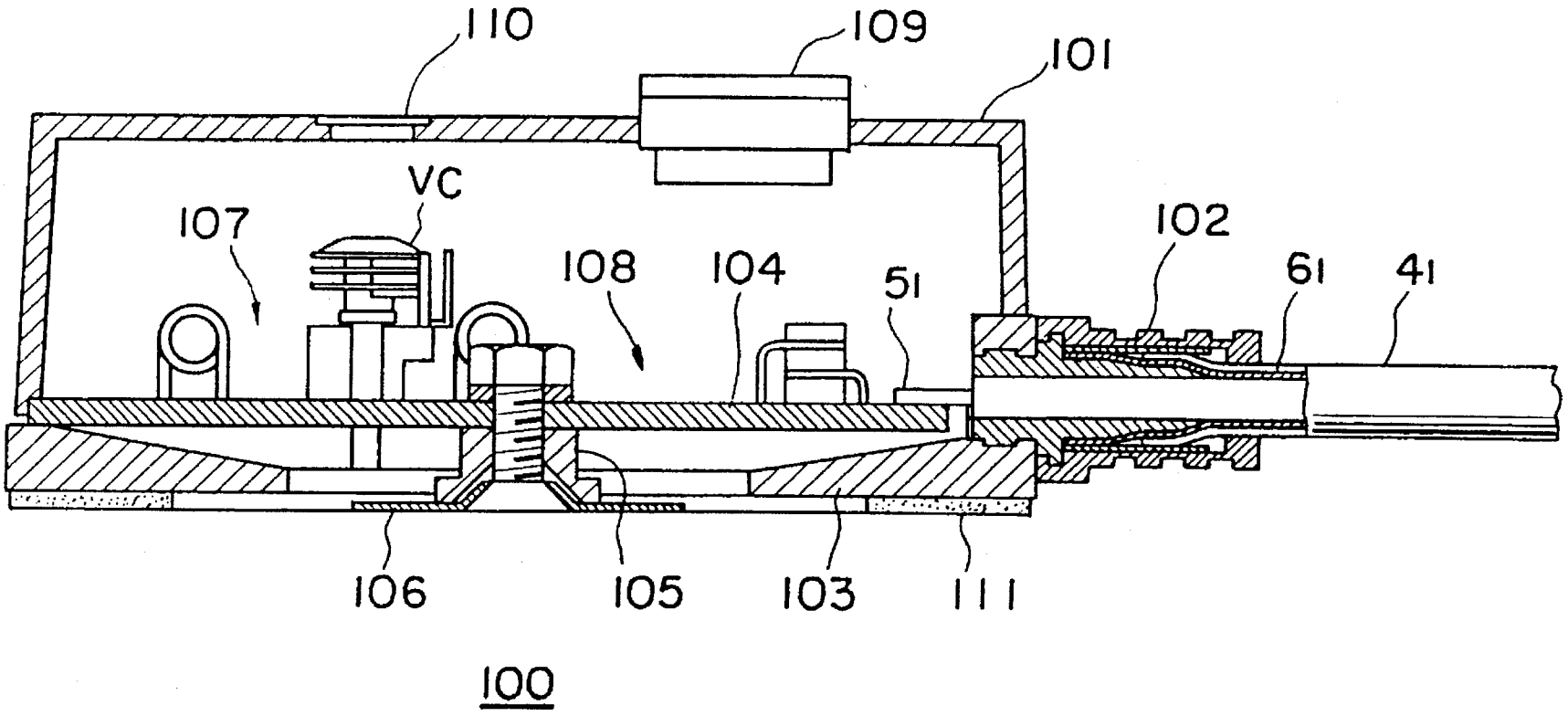
FIG. 28 is a sectional view showing the inner coupling apparatus.

FIG. 28 shows a sectional view of the interior coupling apparatus 100 by cutting X–X' direction in FIG. 27A.

In a portion of a connector 102 in an inner coupling apparatus 100, an outer conductor $6_1$ of a coaxial cable $4_1$ is connected through a connecting metal member to a metallic shield case 101 which is connected to an outer electrode 103. An inner conductor $5_1$ is connected to a central electrode 106 through a measuring circuit 108 formed on a circuit board 104, a variable matching circuit 107 and a metal member 105 for fixing the electrode. The variable matching circuit 107 is used to match both sides of the coaxial cable $4_1$ and the coupling electrode. The measuring circuit 108 measures a matching condition to be delivered and displayed to and by a meter 109. A matching regulation is simplified in the manner that, for example, variable capacitors $VC_1$–$VC_4$ are rotated by a regulating driver through four openings 110 formed in an upper surface of the shield case 101 so as to regulate the meter 109 to be the optimum value. The variable matching circuit 107 is adaptively configured to have a characteristic that a necessary matching is obtained in one or a plurality of frequency band or bands to be used.

Figure 29A:
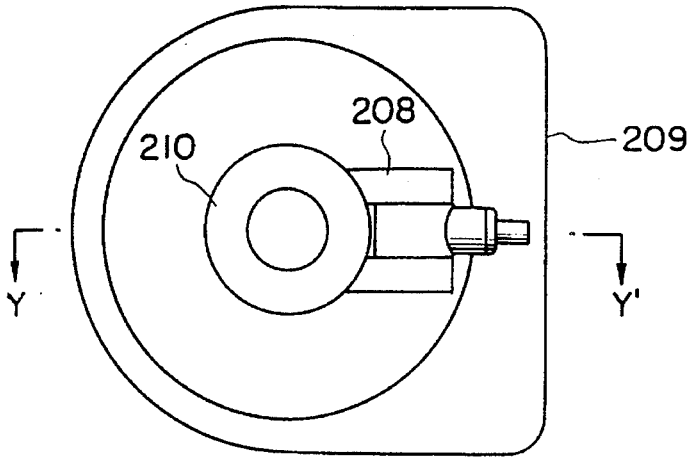
FIG. 29A is a plane view showing an appearance of an inner coupling apparatus constituting the antenna system.
Figure 29B:
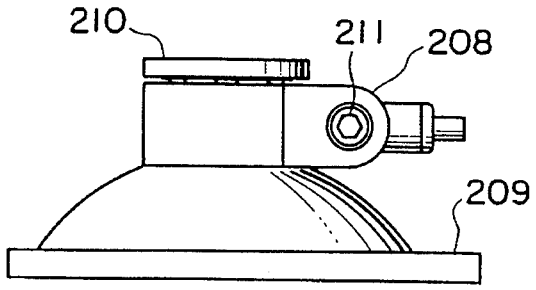
FIG. 29B is a side view showing the inner coupling apparatus.
Figure 29C:
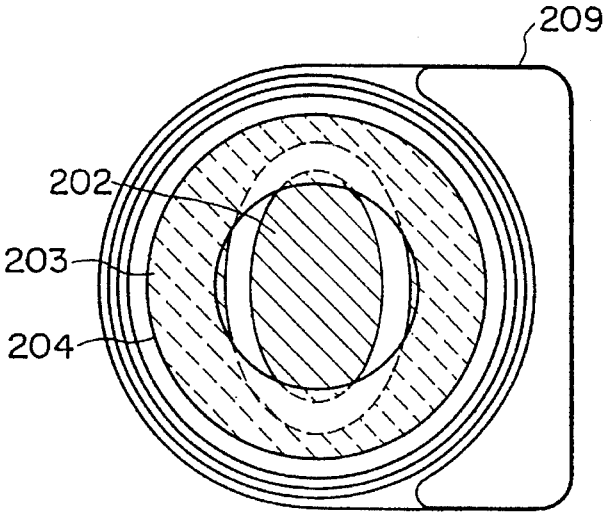
FIG. 29C is a base view showing the inner coupling apparatus.

FIGS. 29A–29C are plane, side and bottom surface views, respectively, with respect to the outer coupling apparatus 200. The outer coupling apparatus 200 is covered by a waterproof cover 209 and cap 210 to protect it from the elements. The outer coupling apparatus 200 has a truncated cone shaped portion installing a circuit board 201 on which an antenna matching circuit is provided for matching an antenna side and a coupling electrode side to each other, and a rotational metal member which is mounted on a summit surface of the truncated cone shaped portion for rotatably connecting a not-shown antenna. An angle in the vertical direction of the antenna can be regulated by a fixing screw 211. An elliptic central electrode 202 and an outer electrode 203 surrounding the electrode 202 are formed on the surface of the circuit board 201 at a bottom plane of the outer coupling apparatus 200 corresponding to the central electrode 106 and outer electrode 103 of the inner coupling apparatus 100. A double adhesive surface tape 204 is attached to the glass plate around the outer electrode 203 for fixing the outer coupling apparatus 200 to the glass plate.

Figure 30:
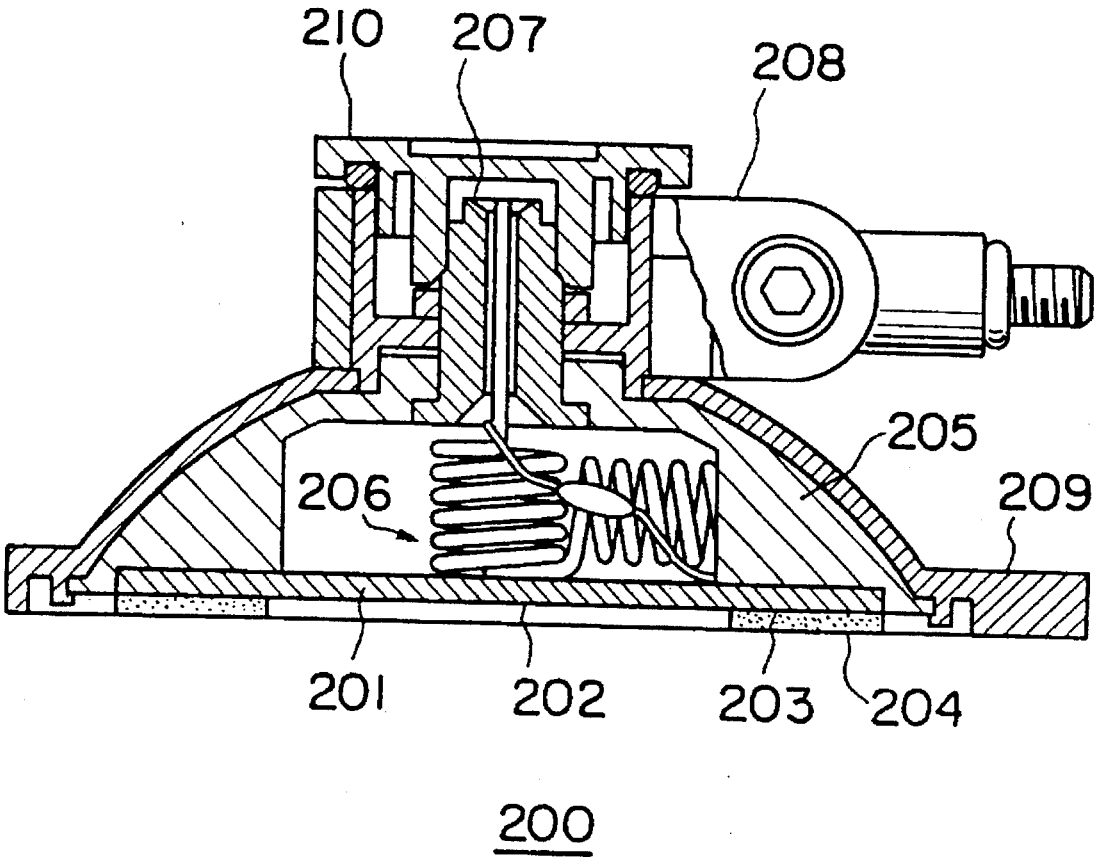
FIG. 30 is a sectional view showing the inner coupling apparatus.

FIG. 30 is a sectional view of the outer coupling apparatus 200 in the Y–Y' direction. A matching coil, capacitor and the like, which form an antenna matching circuit 206, are connected to the upper surface of the circuit board 201 fixed to the outer case 205. The elliptic central electrode 202 and the outer electrode 203 surrounding the electrode 202 are formed by a printed electrode on the lower surface of the circuit board 201. The central and outer electrodes 202 and 203 are connected to the antenna matching circuit 206 by wires (not shown) through a penetrated holes in the board, respectively. The circuit board 201 is fixed to an inner side of the outer case 205 having a truncated cone shape by means of a screw and an adhesive agent (not-shown). The matching circuit 206 is connected through an upper metal member 207 and a rotating metal member 208 on the outer case 205 to the antenna 300 as shown in FIG. 25 or 26. The above-mentioned outer case 205 is covered by the waterproof cover 205 so that it may be used outside of the vehicle or room. The double adhesive surface tape 204 having a ring shape is attached to the lower surface of the circuit board 201 to attach the outer coupling apparatus 200 on the glass plate at the position corresponding to the inner coupling apparatus 100.

Figure 31:
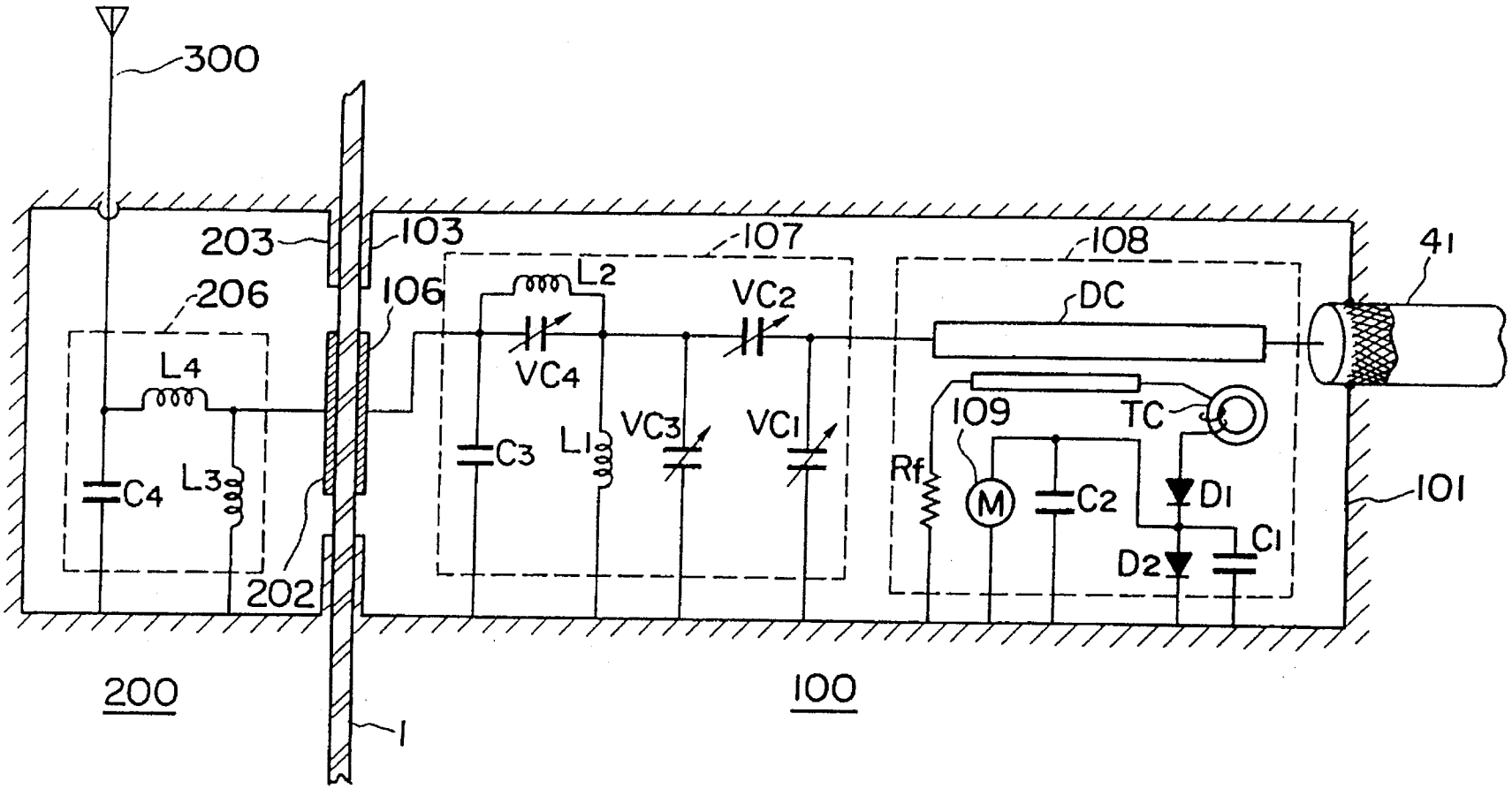
FIG. 31 is a circuit diagram showing an example of an electric circuit of the antenna system.

FIG. 31 shows an example of an electric circuit of an antenna apparatus according to the present invention. The circuit schematically comprises a coaxial cable $4_1$, measuring circuit 108, matching circuit 107, coupling central electrodes 106 and 202, coupling outer electrodes 103 and 203, antenna matching circuit 206 and antenna 300. An inner conductor $5_1$ of the coaxial cable $4_1$ is connected to the antenna 300 through a directional coupler DC in the measuring circuit 108 and using a micro-strip-line, the variable matching circuit 107, the central electrode 106, which are on the side of the inner coupling apparatus 100, and the central electrode 202 and the matching circuit 206 which are on the side of the outer coupling apparatus. The central electrodes 108 and 202 are interconnected by a capacitive coupling. An outer conductor $6_1$ of the coaxial cable $4_1$ is connected through the shield case 101 to the outer electrode 10S coaxially surrounding the central electrode 106 of the inner coupling apparatus 100. The outer electrode 103 is connected by a capacitive coupling to the outer electrode 203 coaxially surrounding the central electrode 202 in the outer coupling apparatus 200. Accordingly, it is possible to obtain an unbalanced output coaxial mode even in the outside of the glass plate. The case of the outer coupling apparatus 200 may be constructed by a non-shield structure corresponding to types of the antenna 300.

The measuring circuit 108 is configured from an ordinary passing-through type power meter (a standard wave ratio —SWR— meter). In the case where the circuit 108 is more simply configured, progressive wave and reflected wave components are extracted by the directional coupler DC which is connected to the central conductor of the coaxial cable $4_1$ according to the instant embodiment. While the progressive wave component is absorbed by a resistor $R_f$, the reflected wave component is added through a toroidal core TC to a detecting and smoothing circuit which is comprised of the shot key diodes $D_1$ and $D_2$ and capacitor $C_1$ to obtain an average value of the reflected wave component, thereby displaying a level of the reflected wave power corresponding to the average value by the meter 109 and a capacitor $C_2$.

The variable matching circuit 107 matches an impedance of a portion on the left side of the circuit 107 including the coupling electrodes 106 and 202 of the coupling capacitor, antenna matching circuit 206 and antenna 300, with an impedance of a portion on the right side of the circuit 107 including a measuring circuit 108, coaxial cable $4_1$ and not-shown transmission reception apparatus. The variable matching circuit 107 corresponds to the composite matching circuit $1_{p1}$ as shown in FIG. 12 and having a formation for setting a plurality of passing frequency bands to a pair of the central electrodes. In this embodiment, the composite matching circuit comprises variable capacitors $VC_1$–$VC_3$ forming π type circuit, a capacitor $C_3$ which is connected between the central electrode 106 and the outer electrode 103, an inductance $L_2$ which is connected between the central electrode 106 and the π type circuit, a variable capacitor $VC_4$ connected between both ends of the inductance $L_2$, and an inductance $L_1$ connected between the inductance $L_2$ and the outer electrode 103. The inductance $L_2$ corresponds to the inductance $L_{21}$ connected in series to the central electrode as shown in FIG. 3A, while the inductance $L_1$ corresponds to the inductance $L_{21}'$ connected between the central electrode and outer electrode as shown in FIG. 5A. Such composite matching circuit is a multiple-tuning circuit capable of tuning with two frequencies such as 144 MHz and 435 MHz. The variable capacitors $VC_1$–$VC_4$ is provided for a fine regulation. When the transmission reception apparatus issues a high frequency signal having a required frequency, since positions of the variable capacitors $VC_1$–$VC_4$ are set in the manner that the meter 109 displays the optimum directed value for displaying the level of the reflected wave power, it is possible to simplify a matching regulation.

The antenna matching circuit 206 is comprised of a π type circuit including an inductances $L_3$ and $L_4$ and a capacitor $C_4$ to match the antenna 300 side and the coupling capacitor (the coupling electrodes 106 and 202).

Even though there are provided two matching circuits in the above-description, the present invention can comprise any one of the matching circuits 107 and 206 to match an impedance in the coupling apparatus.

Figure 32:
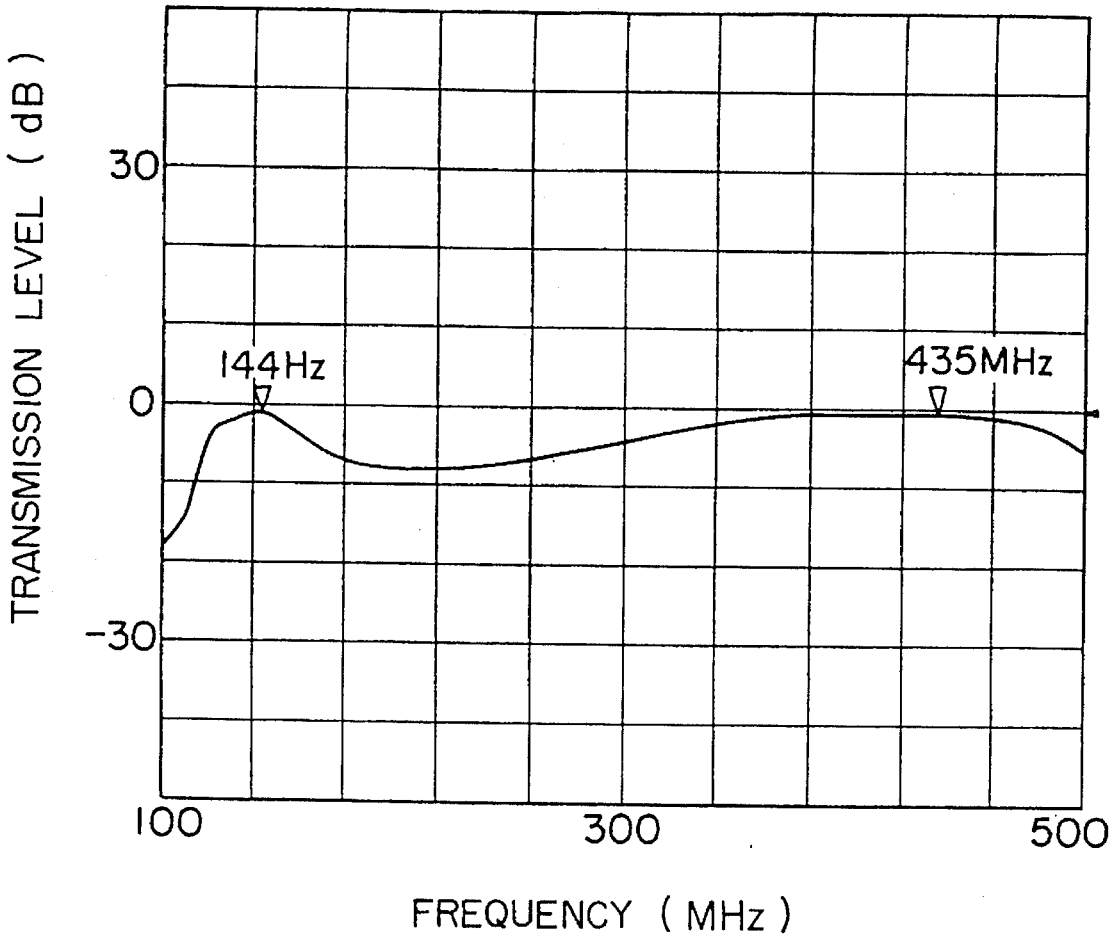
FIG. 32 is a graph showing an example of a transmission characteristic corresponding to a frequency in a coupling apparatus provided in the antenna system.

FIG. 32 shows a measured result of the transmission characteristics which occur when the inner coupling apparatus 100 and the outer coupling apparatus are arranged in the antenna system in the manner of opposing to each other through the glass plate, a loss of the high frequency signal during passing through the glass plate is measured by various kinds of frequency by means of power meters connected with both of the coupling apparatus. In this example, there are 1:1.2 of an average ratio between a peripheral diameter of the central electrode and an internal diameter of the outer electrode and an area of the central electrode is 10 $cm^2$. In 144 MHz or 435 MHz as a required frequency corresponding to the regulation of the matching circuit, there are obtained gains of −0.54 dB and −0.53 dB, respectively. Accordingly, there is realized a signal transmission having little attenuation and passing through the glass plate 1. At this time, the SWR is less than 1.5, thereby causing no problems when used with for this kind of mobile radio system.

Figure 1A:
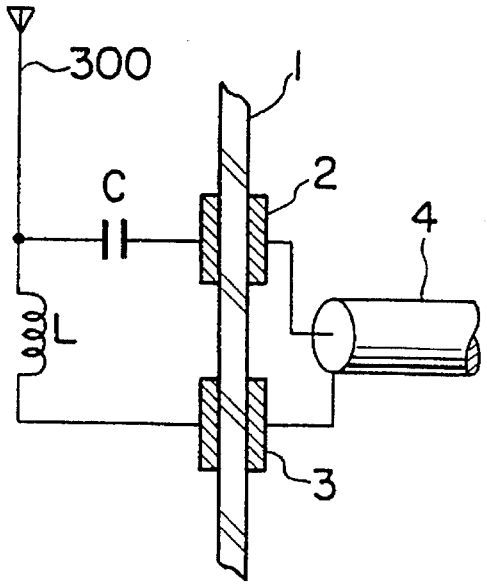
FIG. 1A PRIOR ART
FIGS. 1A and 1B are explanatory views showing examples of the conventional glass passing through type antenna, respectively.
Figure 1B:
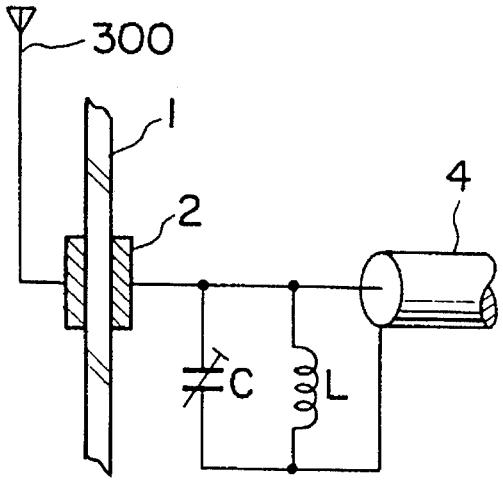
FIG. 1B PRIOR ART

Furthermore, there is a comparison result of the signal strength of the conventional antenna system shown in FIG. 1A and the antenna system having the same structure when both of the antenna systems are attached to the rear window of the vehicle and communicates signals having 144 MHz between the vehicle and a portion 2 km distant from the vehicle. As a result, it is confirmed that the antenna system of this invention can improve 2 dB of gain. In the same manner, there is a comparison result between the conventional antenna system shown in FIG. 1B and the system according to the present invention having the same structure. As a result, it is also confirmed that the antenna system of this invention can improve 2 dB of gain.

The coaxial cable coupling apparatus according to the present invention can electrically and effectively couple coaxial cables on both side inside and the outside of a glass plate to each other through a dielectric portion such as a glass plate by maintaining a shielded condition in the closed space and without forming openings in walls of the closed space such as a cabin or a room. Furthermore, it is possible to succeedingly maintain the coaxial transmission mode and the unbalanced transmission as a merit of the coaxial cable even inside and outside the dielectric plate portion. Still furthermore, since it is possible to set a plurality of frequencies for matching with the coupling capacitor, it is possible to transmit signals in wide frequency band. Therefore, the coupling apparatus of this invention can be applied to a coaxial cable for transmissions which require a high transmission efficiency which has not be able to be utilized by the conventional apparatus so as to be suitable for a mobile radio transmission reception apparatus.

Figure 33:
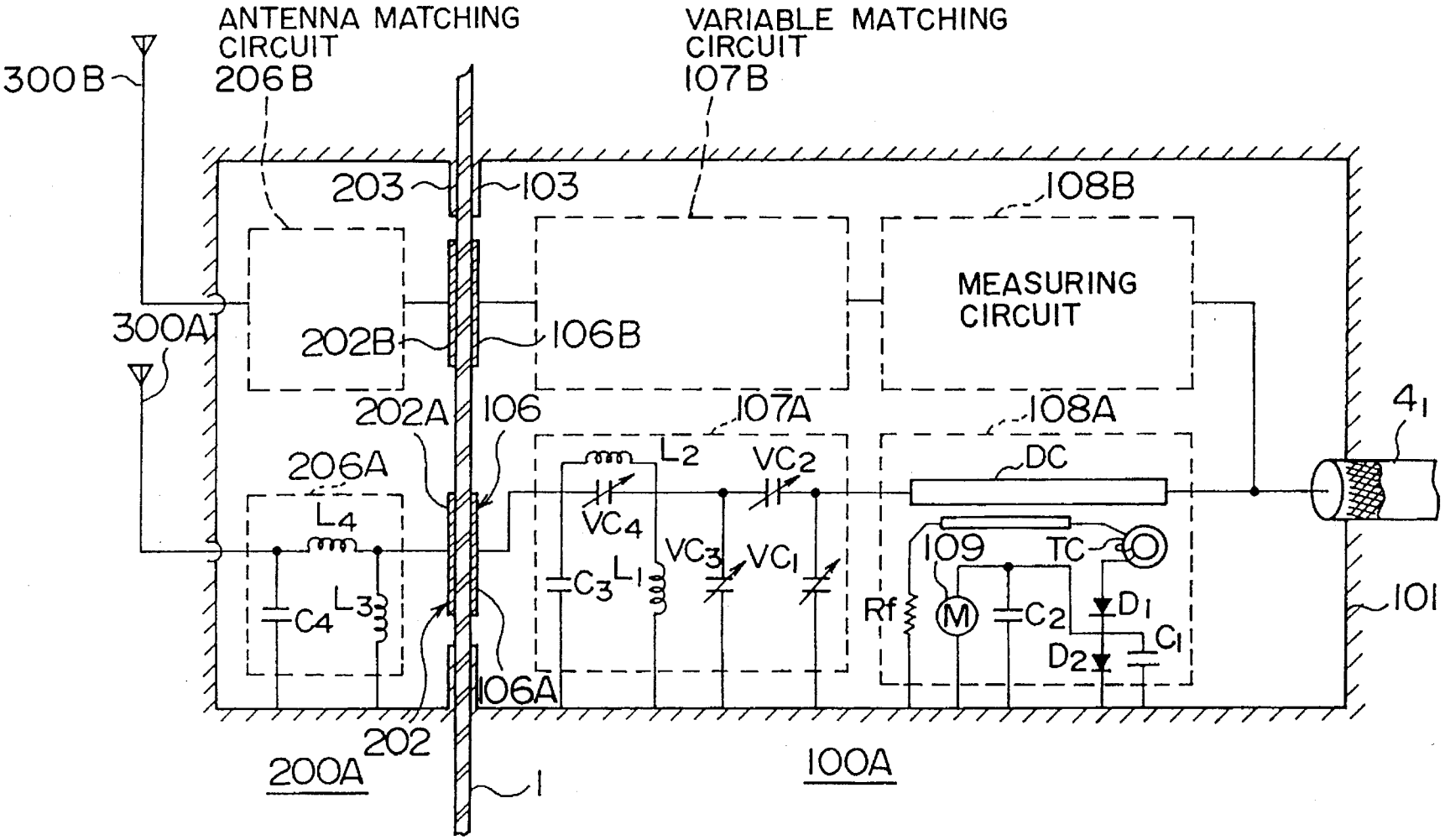
FIG. 33 is a circuit diagram showing an electric circuit example of the antenna system having a plurality of central electrodes.

The coaxial cable coupling apparatus used in the antenna system according to the present invention, should be desirable to one having a plurality of the central electrodes more than one having a single central electrode. FIG. 33 shows an antenna system comprising inner and outer coupling apparatus 100A and 200A respectively having a plurality of central electrodes.

The antenna system shown in FIG. 33 comprises a plurality of antennas 300A and 300B for respectively receiving radio waves having different frequencies. The outer coupling apparatus 200A comprises two central electrodes 202A and 202B, and two antenna matching circuits 206A and 206B which are respectively provided between the antennas 300A, 300B and the electrodes 202A, 202B. Since the antenna matching circuit 206B has the detailed configuration as the same that of the circuit 206A, a detailed arrangement is eliminated in FIG. 33.

The antenna system shown in FIG. 33 includes an inner coupling apparatus 100A further comprising a plurality of central electrodes 106A and 106B corresponding to the central electrodes 202A and 202B on the antenna side. Between the central electrode 106A and the cable $4_1$, there are provided a matching circuit 107A and a measuring circuit 108A corresponding to the matching circuit 107 and the measuring circuit 108 in FIG. 31. Also, between the central electrode 106B and the coaxial cable $4_1$, there are provided a matching circuit 107B and a measuring circuit 108B respectively having the same structures (detailed configuration is omitted in the figure) as that of the circuit 107 and 108. By such a constitution, this embodiment has the same function and effect as those of the embodiment shown in FIGS. 15A and 15B.

What is claimed is:

1. An apparatus for coupling a plurality of coaxial cables to each other through a dielectric plate, said apparatus comprising:

a pair of central electrodes disposed on each side of said dielectric plate and disposed opposite each other, each central electrode having a plate shape and a predetermined area, and each of said central electrodes being connected to a respective central conductor of said coaxial cables;

a pair of outer electrodes disposed on each side of said dielectric plate and disposed opposite each other, each of said outer electrodes surrounding a corresponding one of said central electrodes and being connected to a respective outer conductor of each of said coaxial cables; and a matching circuit provided between said central electrode and said central conductor of the coaxial cable;

wherein the predetermined areas of said central electrodes are sufficient to permit capacitive coupling between said central electrodes.

2. The apparatus for coupling coaxial cables according to claim 1, wherein at least one side of said pair of central electrodes is configured from a plurality of planar electrodes which are independent from each other.

3. The apparatus for coupling coaxial cables according to claim 1, wherein both of said pair of central electrodes and said matching circuit are installed in a shield case which is connected to said outer conductor of said coaxial cable.

4. The apparatus for coupling coaxial cables according to claim 3, wherein at least one side of said pair of central electrodes is configured from a plurality of planar electrodes which are independent from each other.

5. The apparatus for coupling coaxial cables according to claim 4, wherein each of said planar electrodes is connected to a central conductor of one coaxial cable through a plurality of matching circuits having different band-pass characteristics.

6. The apparatus for coupling coaxial cables according to claim 4, wherein each of said planar electrodes is connected to a central conductor of said plurality of coaxial cables through a plurality of matching circuits having different band-pass characteristics.

7. The apparatus for coupling coaxial cables according to claim 1, wherein said matching circuit comprises an inductor connected between said central conductor and said central electrode, and another inductor connected between said outer electrode and said central electrode.

8. The apparatus for coupling coaxial cables according to claim 1, wherein said matching circuit comprises a variable matching circuit.

9. The apparatus for coupling coaxial cables according to claim 1, wherein said coaxial cable is loaded by a toroidal core.

10. An antenna system including a dielectric plate, an antenna portion mounted on the dielectric plate, and a coaxial cable for supplying a high frequency power through the dielectric plate to the antenna, said antenna system comprising:

a pair of central electrodes disposed on each side of said dielectric plate and disposed opposite each other, each central electrode having a plate shape and a predetermined area, and one of said central electrodes being connected to a central conductor of said coaxial cable;

a pair of outer electrodes disposed on each side of said dielectric plate and disposed opposite each other, said outer electrodes surrounding said central electrodes, and one of said outer electrodes being connected to an outer conductor of said coaxial cable on one side;

a first matching circuit provided between said central conductor of said coaxial cable and said central electrode on one side; and a second matching circuit provided between said central conductor of said coaxial cable and said central electrode on the other side;

wherein the predetermined areas of said central electrodes are sufficient to permit capacitive coupling between said central electrodes.

11. The antenna system according to claim 10, wherein said first matching circuit is comprised of a variable matching circuit.

12. The antenna system according to claim 11, wherein at least one of said central electrodes is comprised of a plurality of planar electrodes which are independent from each other.

13. The antenna system according to claim 10, wherein each of said first and second matching circuits comprises said central conductor, an inductor connected between said central conductor of said coaxial cable and said central electrode on any surface of said dielectric plate.

14. The antenna system as claimed in claim 10, wherein said matching circuits are constructed to function like each other.

15. The antenna system according to claim 10, wherein a matching display apparatus is provided in a coupling apparatus for displaying a matching condition.

16. The antenna system according to claim 15, wherein said matching display apparatus, said central electrode and said matching circuit are installed in a shield case which is connected to said outer conductor of said coaxial cable.

* * * * *